US010976111B2

(12) United States Patent
Machida

(10) Patent No.: US 10,976,111 B2
(45) Date of Patent: Apr. 13, 2021

(54) LOOP TYPE HEAT PIPE

(71) Applicant: SHINKO ELECTRIC INDUSTRIES CO., LTD., Nagano (JP)

(72) Inventor: Yoshihiro Machida, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 76 days.

(21) Appl. No.: 16/168,194

(22) Filed: Oct. 23, 2018

(65) Prior Publication Data

US 2019/0128620 A1 May 2, 2019

(30) Foreign Application Priority Data

Oct. 27, 2017 (JP) ..... JP2017-207937
Mar. 7, 2018 (JP) ..... JP2018-040520

(51) Int. Cl.
*F28F 7/00* (2006.01)
*F28D 15/04* (2006.01)
*F28D 15/02* (2006.01)

(52) U.S. Cl.
CPC ..... *F28D 15/043* (2013.01); *F28D 15/0266* (2013.01); *F28D 15/046* (2013.01)

(58) Field of Classification Search
CPC ... F28D 15/043; F28D 15/0266; F28D 15/046
USPC ..... 165/80.4
See application file for complete search history.

(56) References Cited

U.S. PATENT DOCUMENTS 4,550,774 A * 11/1985 Andres ..... F28D 15/0233 165/104.14
5,761,037 A * 6/1998 Anderson ..... F28D 15/0266 165/104.26
5,774,334 A * 6/1998 Kawamura ..... H01L 23/4338 165/80.4
5,937,936 A * 8/1999 Furukawa ..... F28D 15/0233 165/104.33

(Continued)

FOREIGN PATENT DOCUMENTS

CN 201636448 11/2010
CN 101900504 12/2010

(Continued)

OTHER PUBLICATIONS

European Search Report dated Mar. 29, 2019, 5 pages.
Chinese Office Action dated Jan. 13, 2021, English translation included, 17 pages.

*Primary Examiner* — Claire E Rojohn, III
(74) *Attorney, Agent, or Firm* — Rankin, Hill & Clark LLP

(57) ABSTRACT

A loop type heat pipe includes: an evaporator configured to vaporize a liquid working fluid; a condenser configured to condense the vaporized working fluid into the liquid working fluid; a vapor pipe provided between the evaporator and the condenser; and a liquid pipe provided between the evaporator and the condenser. Each of the vapor pipe and the liquid pipe includes: a lower-side metal layer; an intermediate metal layer that is disposed on the lower-side metal layer; an upper-side metal layer that is disposed on the intermediate metal layer; and a conduit that is formed by the lower-side metal layer, the intermediate metal layer, and the upper-side metal layer, and at least one of the upper-side metal layer and the lower-side metal layer warps outward in a first portion of the vapor pipe.

10 Claims, 28 Drawing Sheets

(56) References Cited

U.S. PATENT DOCUMENTS 6,097,597 A * 8/2000 Kobayashi ..... F28D 15/0233 165/104.14
6,164,368 A 12/2000 Furukawa et al.
6,397,935 B1 * 6/2002 Yamamoto ..... F28D 15/0233 165/104.21
6,729,383 B1 * 5/2004 Cannell ..... F28F 3/022 165/185
6,981,543 B2 * 1/2006 Chesser ..... F28D 15/043 165/104.13
7,000,684 B2 * 2/2006 Kenny ..... F04B 17/00 165/104.21
7,080,680 B2 * 7/2006 Ota ..... F28D 15/0233 165/104.33
7,188,662 B2 * 3/2007 Brewer ..... H01L 23/473 165/80.4
7,578,337 B2 * 8/2009 Spokoiny ..... H05K 7/20254 165/109.1
7,992,625 B1 * 8/2011 Spokoiny ..... F28F 3/12 165/80.4
8,479,805 B2 * 7/2013 Chang ..... F28F 3/12 165/80.3
8,919,426 B2 * 12/2014 Hardesty ..... F28D 15/0233 165/104.21
8,929,073 B2 * 1/2015 Suzuki ..... F28D 15/046 361/700
9,464,849 B2 * 10/2016 Uchida ..... F28D 15/0266
10,177,075 B2 * 1/2019 Bezama ..... F28D 15/00
10,458,716 B2 * 10/2019 Hulse ..... F28D 15/02
10,619,941 B2 * 4/2020 Huang ..... F28F 3/12
2003/0024691 A1 * 2/2003 Tsay ..... F28D 15/0233 165/104.26
2007/0240857 A1 * 10/2007 Hou ..... F28D 15/046 165/104.26
2010/0326632 A1 * 12/2010 Nagai ..... F28F 3/086 165/104.26
2016/0259383 A1 * 9/2016 Shioga ..... G06F 1/203
2018/0087844 A1 * 3/2018 Huang ..... F28F 9/26
2019/0293362 A1 * 9/2019 Machida ..... F28D 15/0266
2020/0018556 A1 * 1/2020 Machida ..... F28D 15/0283
2020/0049417 A1 * 2/2020 Machida ..... F28D 15/0233
2020/0049419 A1 * 2/2020 Machida ..... H05K 7/20336
2020/0064077 A1 * 2/2020 Machida ..... F28D 15/0233
2020/0096261 A1 * 3/2020 Tanaka ..... F28D 15/043
2020/0124353 A1 * 4/2020 Machida ..... F28D 15/043

FOREIGN PATENT DOCUMENTS

JP H10-122774 5/1998
JP 11-037678 2/1999
JP 2011-085372 4/2011
JP 2015-132400 A 7/2015
JP 2015132400 A * 7/2015 ..... F28D 15/0266
WO 2015/087451 6/2015

* cited by examiner

LOOP TYPE HEAT PIPE

This application claims priority from Japanese Patent Applications No. 2017-207937 filed on Oct. 27, 2017, and No. 2018-040520 filed on Mar. 7, 2018, the entire contents of which are herein incorporated by reference.

BACKGROUND

1. Technical Field

The present disclosure relates to a loop type heat pipe.

2. Background Art

There are loop type heat pipes each of which serves as a device to transport heat generated by an electronic apparatus such as a smartphone. Such a loop type heat pipe is a device that uses phase change of a working fluid to transport heat. The loop type heat pipe has a loop-shaped conduit in which the working fluid is enclosed.

In the loop type heat pipe, the working fluid flows through the conduit in one direction to thereby transport heat generated by an electronic component to a condenser. Therefore, when the resistance the working fluid receives from the conduit is too large, the working fluid cannot transport the heat efficiently (see e.g., WO 2015/087451, JP-A-10-122774, and JP-A-11-37678).

SUMMARY

Certain embodiments provide a loop type heat pipe. The loop type heat pipe includes: an evaporator that is configured to vaporize a liquid working fluid; a condenser that is configured to condense the vaporized working fluid into the liquid working fluid; a vapor pipe that is provided between the evaporator and the condenser and through which the vaporized working fluid flows; and a liquid pipe that is provided between the evaporator and the condenser and through which the liquid working fluid flows. Each of the vapor pipe and the liquid pipe comprises: a lower-side metal layer; an intermediate metal layer that is disposed on the lower-side metal layer; an upper-side metal layer that is disposed on the intermediate metal layer; and a conduit that is formed by the lower-side metal layer, the intermediate metal layer, and the upper-side metal layer. At least one of the upper-side metal layer and the lower-side metal layer warps outward in a first portion of the vapor pipe.

Certain embodiments provide a method of manufacturing a loop type heat pipe. The loop type heat pipe comprises: an evaporator that is configured to vaporize a liquid working fluid; a condenser that is configured to condense the vaporized working fluid into the liquid working fluid; a vapor pipe that is provided between the evaporator and the condenser and through which the vaporized working fluid flows; and a liquid pipe that is provided between the evaporator and the condenser and through which the liquid working fluid flows. Each of the vapor pipe and the liquid pipe comprises: a lower-side metal layer; an intermediate metal layer that is disposed on the lower-side metal layer; an upper-side metal layer that is disposed on the intermediate metal layer; and a conduit that is formed by the lower-side metal layer, the intermediate metal layer, and the upper-side metal layer. The method comprises: (a) increasing pressure inside the conduit to thereby warp at least one of the upper-side metal layer and the lower-side metal layer outward in a first portion of the vapor pipe; and (b) enclosing the working fluid into the conduit.

DETAILED DESCRIPTION

A matter studied by the present inventor will be described prior to description of embodiments of the invention.

Figure 1:
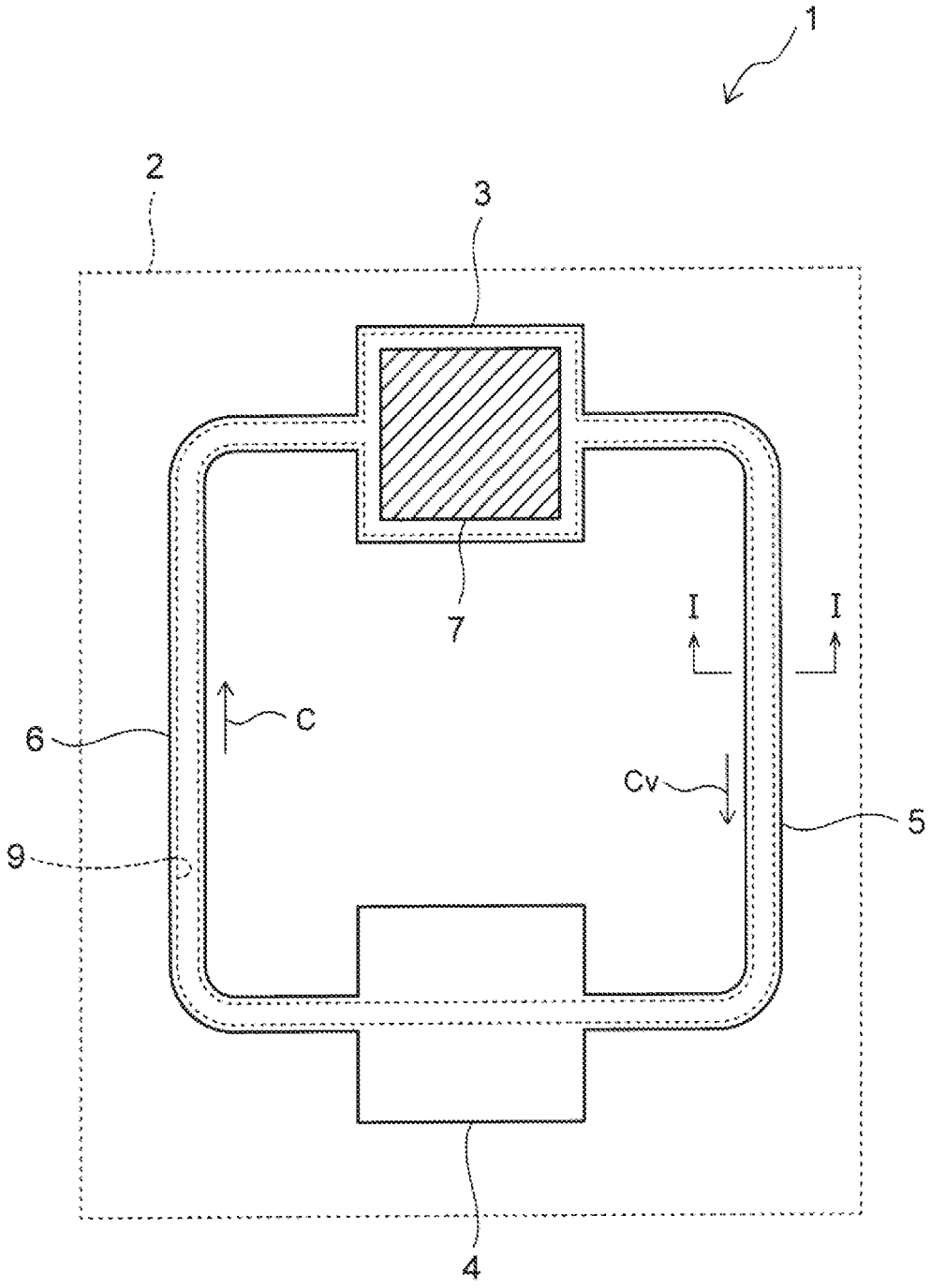
FIG. 1 is a top view of a loop type heat pipe used for study.

FIG. 1 is a top view of a loop type heat pipe used in the study.

The loop type heat pipe 1 is received in a housing 2 of a smartphone, a digital camera, or the like. The loop type heat pipe 1 includes an evaporator 3 and a condenser 4.

A vapor pipe 5 and a liquid pipe 6 are connected to the evaporator 3 and the condenser 4. A loop-shaped conduit 9 through which a working fluid C flows is formed by the pipes 5 and 6. In addition, a heat-generating component 7 such as a CPU (Central Processing Unit) is firmly fixed to the evaporator 3, and vapor Cv of the working fluid C is generated by heat of the heat-generating component 7.

After the vapor Cv is guided to the condenser 4 through the vapor pipe 5 and liquefied in the condenser 4, the liquefied working fluid C is fed again to the evaporator 3 through the liquid pipe 6.

The working fluid C circulates inside the loop type heat pipe 1 in this manner. Consequently, the heat generated by the heat-generating component 7 moves to the condenser 4 so that cooling of the heat-generating component 7 can be accelerated.

Figure 2:
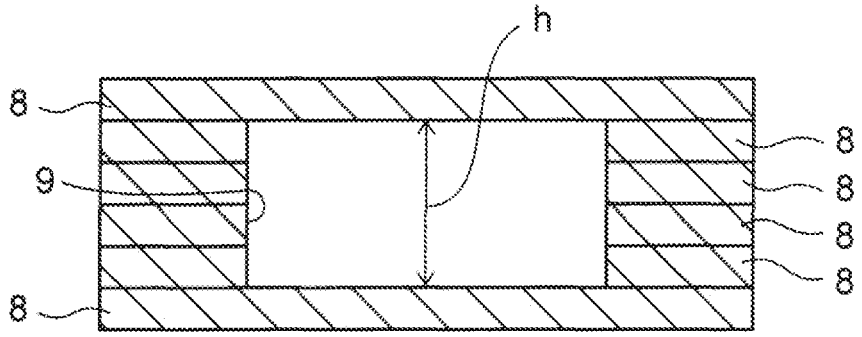
FIG. 2 is a sectional view taken along a line I-I of FIG. 1.

FIG. 2 is a sectional view taken along a line of FIG. 1.

As shown in FIG. 2, a plurality of metal layers 8 are disposed and bonded on one another, and the conduit 9 is formed inside the metal layers 8 in this example.

The metal layers 8 are disposed, so that the loop type heat pipe 1 is manufactured. Thus, a thickness of the loop type heat pipe can be reduced to thereby make it possible to reduce a thickness of the housing 2.

However, a height h of the conduit 9 in this structure corresponds to a total thickness of only about several metal layers 8 disposed on one another. Accordingly, the resistance the working fluid C receives from the conduit 9 increases. For this reason, circulation of the working fluid C inside the loop type heat pipe 1 is hindered. Therefore, it is difficult to transport the heat of the heat-generating component 7 to the condenser 4 by the flow of the working fluid C so that it is difficult to cool the heat-generating component 7 efficiently.

The embodiments of the invention in which the resistance a working fluid receives from a conduit can be reduced will be described below.

First Embodiment

Figure 3:
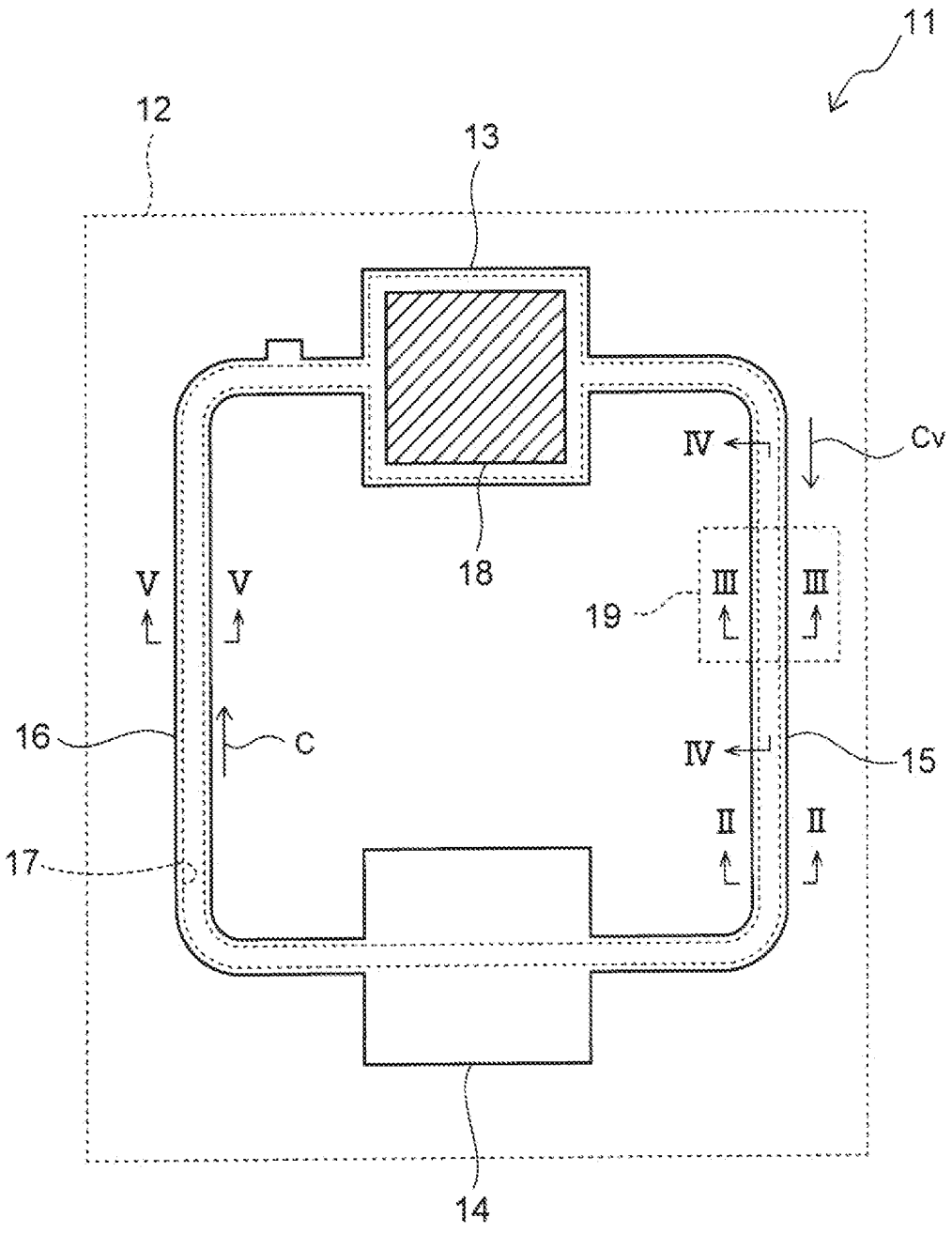
FIG. 3 is a top view of a loop type heat pipe according to a first embodiment.

FIG. 3 is a top view of a loop type heat pipe according to a first embodiment.

The loop type heat pipe 11 is received in a housing 12 of an electronic apparatus. The loop type heat pipe 11 includes an evaporator 13 and a condenser 14. The electronic apparatus is not limited particularly as long as it is an apparatus having a heat-generating component to be cooled. For example, a smartphone, a digital camera, a satellite, an on-vehicle electronic apparatus, a server, or the like, can be used as the electronic apparatus.

A vapor pipe 15 and a liquid pipe 16 are connected to the evaporator 13 and the condenser 14. A loop-shaped conduit 17 through which a working fluid C flows is formed by these pipes 15 and 16. In addition, a heat-generating component 18 such as a CPU is firmly fixed to the evaporator 13. The liquid working fluid C vaporizes due to heat of the heat-generating component 18 so that vapor Cv of the working fluid C is generated.

After the vapor Cv is guided to the condenser 14 through the vapor pipe 15 and liquefied in the condenser 14, the liquefied working fluid C is fed again to the evaporator 13 through the liquid pipe 16.

When the working fluid C circulates inside the loop type heat pipe 11 thus, the heat generated by the heat-generating component 18 moves to the condenser 14 so that cooling of the heat-generating component 18 can be accelerated.

In addition to the heat-generating component 18 to be cooled by the loop type heat pipe 11, an electronic component 19 that does not have to be cooled aggressively is also received inside the housing 12. For example, a surface mount type electronic component to be mounted on a not-shown wiring substrate can be such an electronic component 19.

Incidentally, although only one electronic component 19 is exemplified in FIG. 3, a plurality of electronic components 19 may be provided inside the housing 12.

Figure 4:
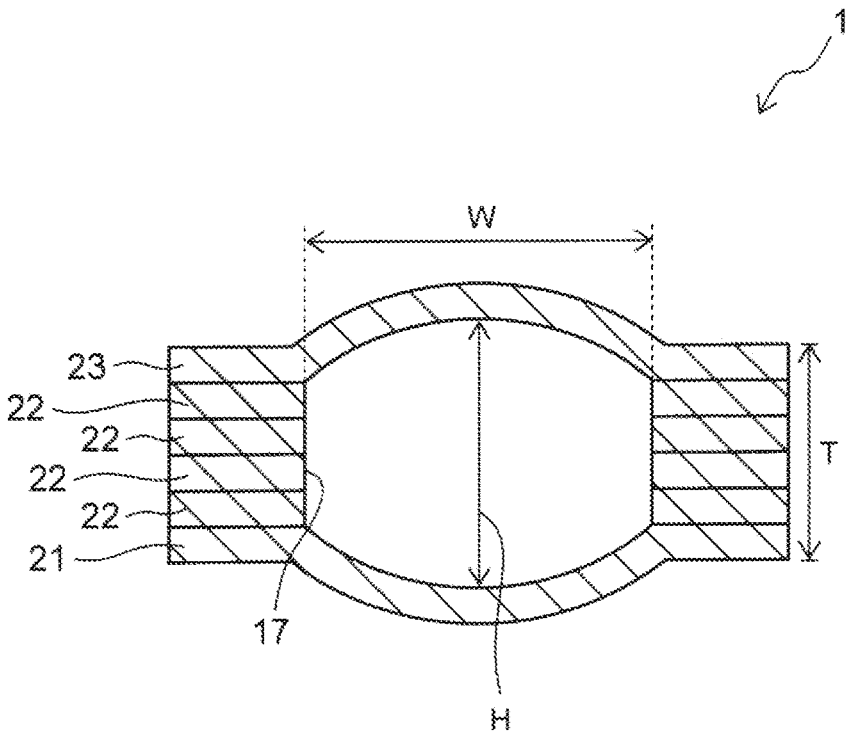
FIG. 4 is a sectional view taken along a line II-II of FIG. 3.

FIG. 4 is a sectional view taken along a line II-II of FIG. 3.

In the present embodiment, as shown in FIG. 4, a lower-side metal layer intermediate metal layers 22 and an upper-side metal layer 23 are disposed on one another in the named order so that a loop type heat pipe 11 is manufactured. The conduit 17 having a width W of about 5 mm to about 10 mm is provided in, of these metal layers, the intermediate metal layers 22. The lower-side metal layer 21 closes the conduit 17 from below, and the upper-side metal layer 23 closes the conduit 17 from above.

The material of each of the metal layers 21 to 23 is not limited particularly. However, a copper layer excellent in thermal conductivity and machinability is used as the metal layer 21 to 23 in the present embodiment. Incidentally, an aluminum layer or a stainless steel layer may be used as the metal layer 21 to 23 in place of the copper layer.

In addition, the thickness of the metal layer 21 to 23 is in a range from 100 μm to 300 μm. For example, the metal layer 21 to 23 is about 100 μm thick. A total thickness T of the metal layers 21 to 23 is in a range of from 300 μm to 2,000 μm. Preferably, the total thickness T is in a range of from 600 μm to 1,800 μm. In addition, a total thickness of the intermediate metal layers 22 is in a range of from 100 μm to 1,800 μm, preferably, in a range of from 400 μm to 1,600 μm.

When the metal layers 21 to 23 each of which is thin in thickness are disposed on one another thus, the loop type heat pipe 11 formed thus can be made thinner in thickness so as to contribute to reduction in the thickness of the housing 12 where the loop type heat pipe 11 is received.

Incidentally, the number of the disposed intermediate metal layers 22 is not limited particularly. Alternatively, only one intermediate metal layer 22 may be provided or a plurality of intermediate metal layers 22 may be disposed on one another.

In addition, the lower-side metal layer 21 and the upper-side metal layer 23 are warped respectively toward the outside of the conduit 17 in the present embodiment. That is, the conduit 17 expands in the thickness direction of the loop type heat pipe 11. Thus, a height H of an approximately widthwise central portion of the conduit 17 is in a range of from 200 μm to 2,500 μm. Preferably, the height H is in a range of from 600 μm to 1,800 μm. In the present embodiment, the conduit 17 is expanded so that the height H of the conduit 17 can be increased. Particularly, the approximately widthwise central portion of the upper-side metal layer 23 warps most largely, and the approximately widthwise central portion of the lower-side metal layer 21 warps most largely. As shown in FIG. 4, the height H of the approximately widthwise central portion of the conduit 17 is preferably larger than the total thickness of the intermediate metal layers 22.

Thus, the resistance the working fluid C receives from the conduit 17 is reduced. Accordingly, the working fluid C can circulate inside the loop type heat pipe 11 more easily. As a result, it is easier to transport the heat of the heat-generating component 18 to the condenser 14 by the flow of the working fluid C so that it is possible to cool the heat-generating component 18 more efficiently.

As shown in FIG. 3, the electronic component 19 is provided inside the housing 12. A portion of the loop type heat pipe 11 overlapping with the electronic component 19 in plan view is located near the electronic component 19. Therefore, it is difficult to warp both the lower-side metal layer 21 and the upper-side metal layer 23.

For this reason, in the present embodiment, the warp of one of the metal layers 21 and 23 is suppressed in the following manner in the portion of the loop type heat pipe 11 overlapping with the electronic component 19 in plan view.

Figure 5:
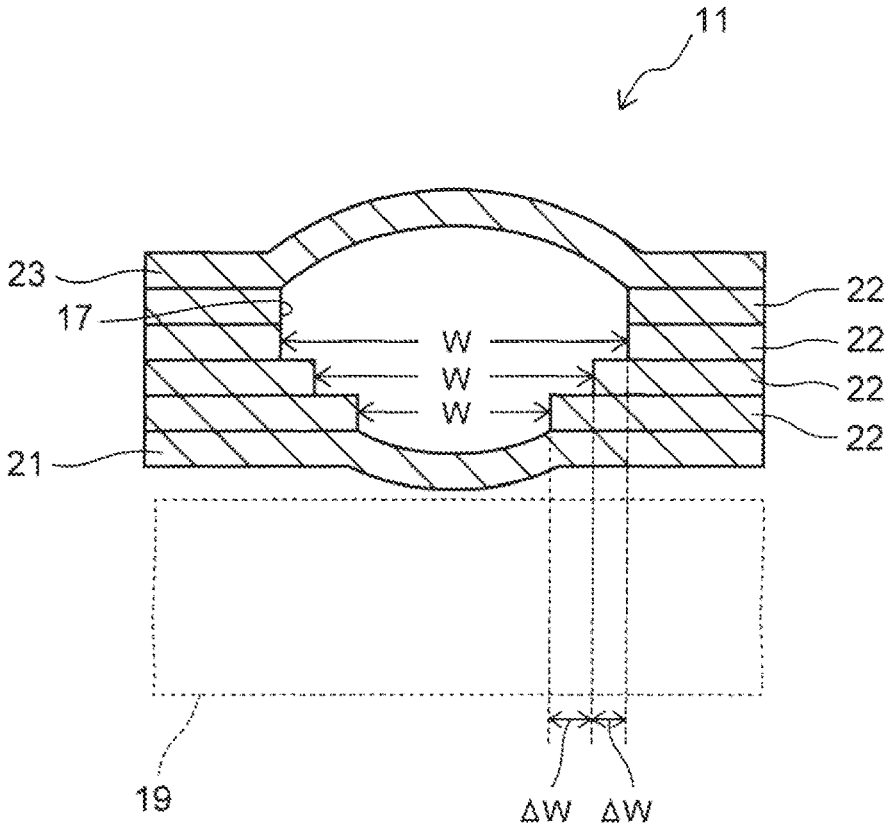
FIG. 5 is a sectional view taken along a line III-III of FIG. 3.

FIG. 5 is a sectional view taken along a line III-III of FIG. 3. FIG. 5 corresponds to the sectional view of the portion of the loop type heat pipe 11 overlapping with the electronic component 19.

As shown in FIG. 5, in this portion, the width W of the conduit 17 formed in the respective intermediate metal layers 22 is stepwise narrowed from the upper-side metal layer 23 toward the lower-side metal layer 21. As will be descried later, the lower-side metal layer 21 or the upper-side metal layer 23 warps outward when pressure inside the conduit 17 is increased. Accordingly, when the width W is thus stepwise narrowed toward the lower-side metal layer 21, the portion of the lower-side metal layer 21 that receives the pressure from the inside of the conduit 17 is reduced. As a result, a bending amount of the lower-side metal layer 21 is smaller than that of the upper-side metal layer 23.

As a result, even when the electronic component 19 is present under the lower-side metal layer, the loop type heat pipe 11 can be prevented from contacting the electronic component 19.

Incidentally, a difference ΔW of the width W between vertically adjacent ones of the intermediate metal layers 22 is not limited particularly. In this example, the difference ΔW is however set in a range of from about 200 μm to about 500 μm.

Figure 6:
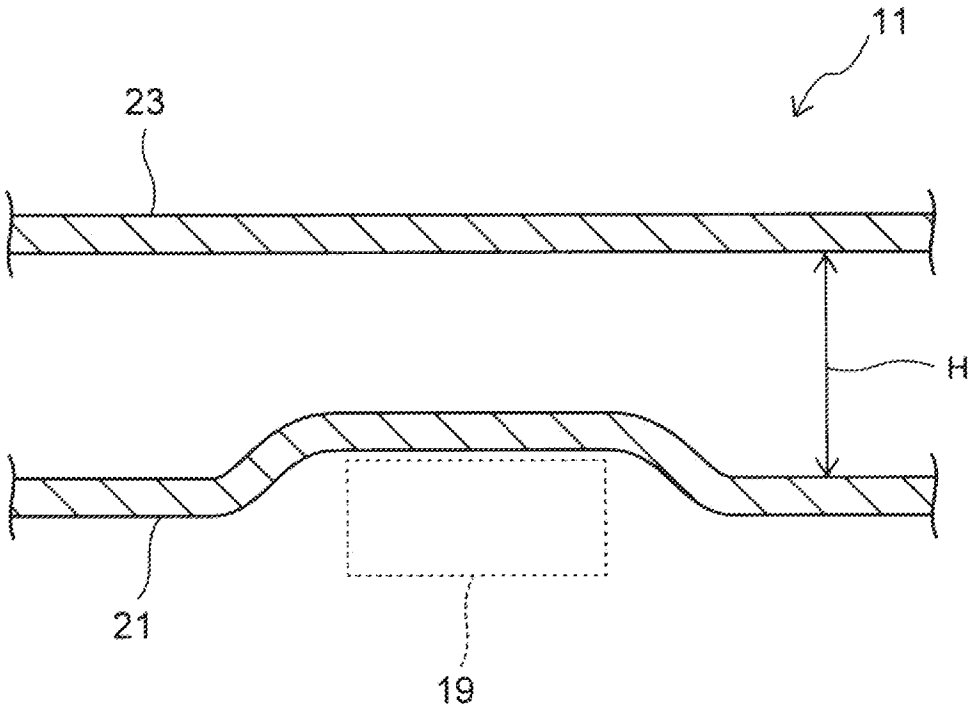
FIG. 6 is a sectional view taken along a line IV-IV of FIG. 3.

FIG. 6 is a sectional view taken along a line IV-IV of FIG. 3. FIG. 6 corresponds to the sectional view of the loop type heat pipe 11 taken along the flow direction of the working fluid C.

As shown in FIG. 6, the height H of the conduit 17 in each portion from which the electronic component 19 is absent is secured to be large due to the expansion of the lower-side metal layer 21. At the same time, the expansion of the lower-side metal layer 21 above the electronic component 19 is suppressed so that the loop type heat pipe 11 can be prevented from contacting the electronic component 19.

Next, the structure of the liquid pipe 16 will be described.

Figure 7:
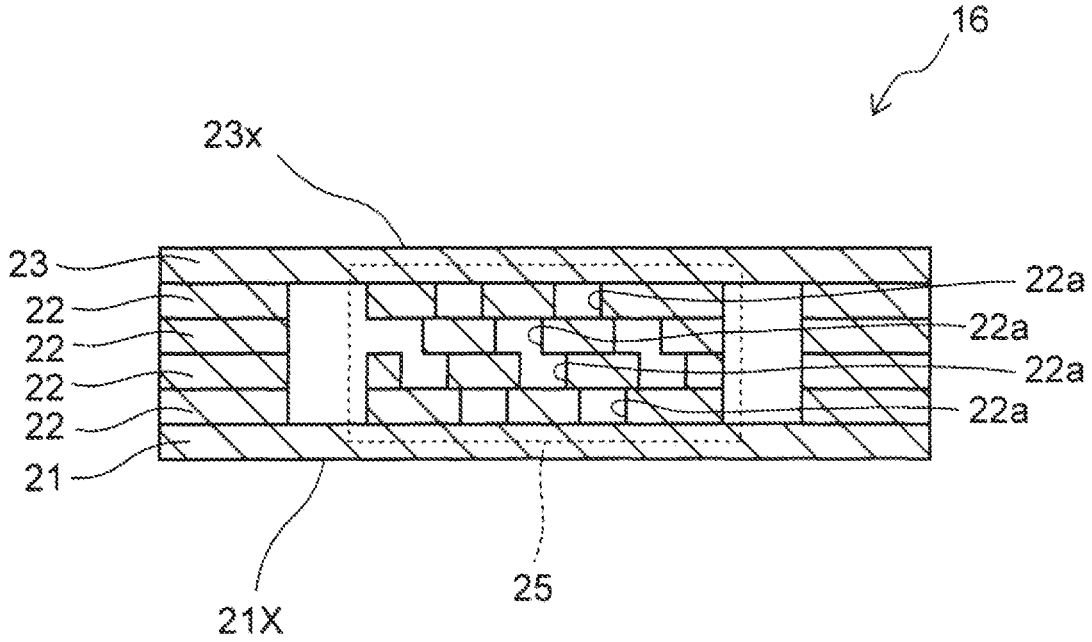
FIG. 7 is a sectional view taken along a line V-V of FIG. 3.

FIG. 7 is a sectional view taken along a line V-V of FIG. 3. FIG. 7 corresponds to the sectional view of the liquid pipe 16.

As shown in FIG. 7, a porous member 25 for holding the liquid working fluid C is provided in the liquid pipe 16. The porous member 25 is formed from the intermediate metal layers 22 and fine pores 22*a* provided in each of the intermediate metal layers 22. Vertically adjacent ones of the pores 22*a* communicate with each other. Thus, a fine three-dimensional channel through which the liquid working fluid C flows is formed by the pores 22*a* communicating with one another. Capillarity acting on the working fluid C from the porous member 25 serves as driving force for moving the working fluid C inside the liquid pipe 16 toward the evaporator 13.

The lower-side metal layer 21 and the upper-side metal layer 23 in the liquid pipe 16 are bonded to the porous member 25. Accordingly, due to restriction on outward warp of the lower-side metal layer 21 and the upper-side metal layer 23, respective outer-side surfaces 21*x* and 23*x* of the lower-side metal layer 21 and the upper-side metal layer 23 are flat.

Figure 8:
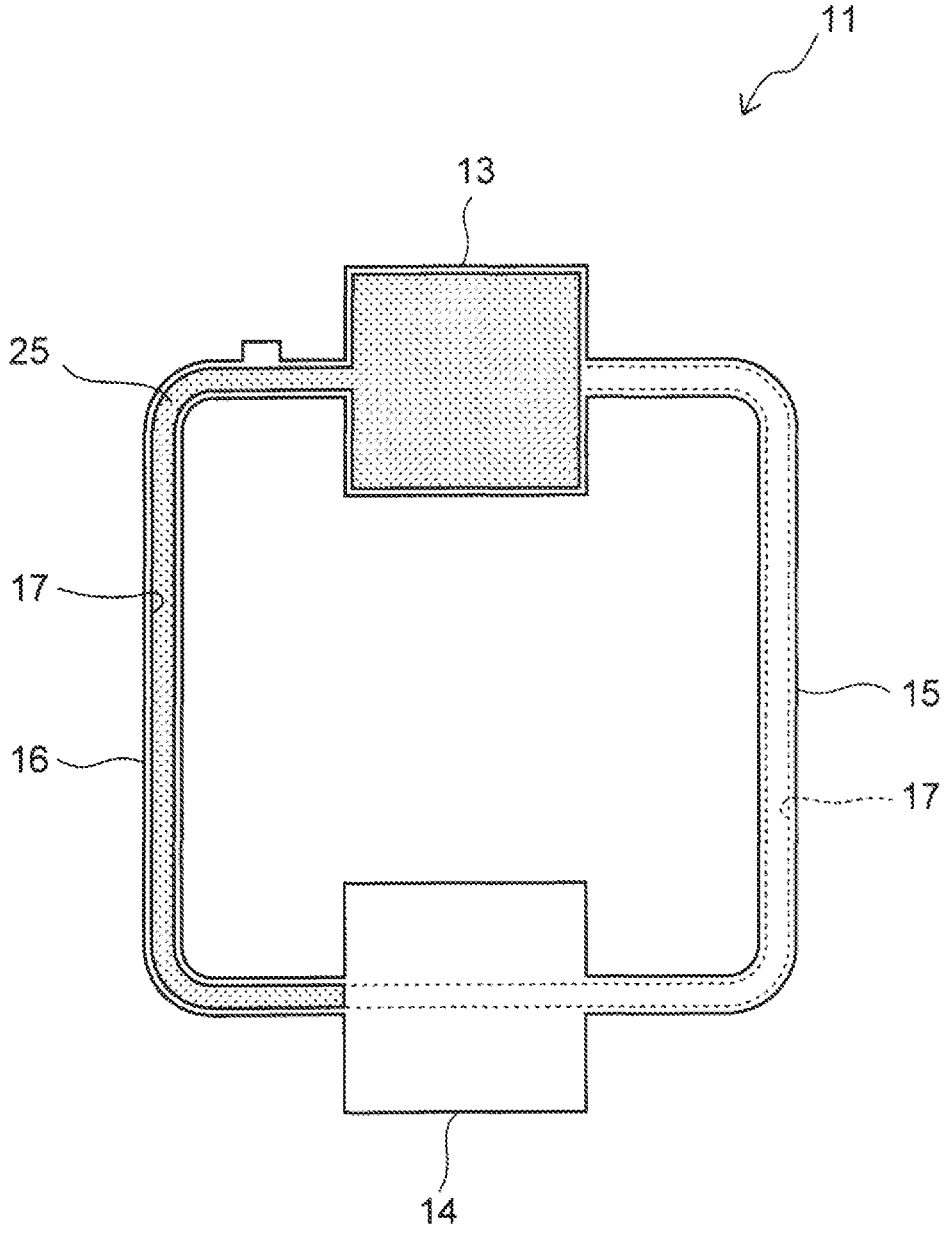
FIG. 8 is a plan view for explaining a region where a porous member is provided in the first embodiment.

FIG. 8 is a plan view for explaining a region where the porous member 25 is provided.

In the example of FIG. 8, the porous member 25 is provided in the entire region of the liquid pipe 16 and the evaporator 13.

Incidentally, the porous member 25 may be provided in only a portion of the liquid pipe 16 in the following manner as long as the driving force for moving the working fluid C toward the evaporator 13 can be obtained satisfactorily by the porous member 25.

Figure 9:
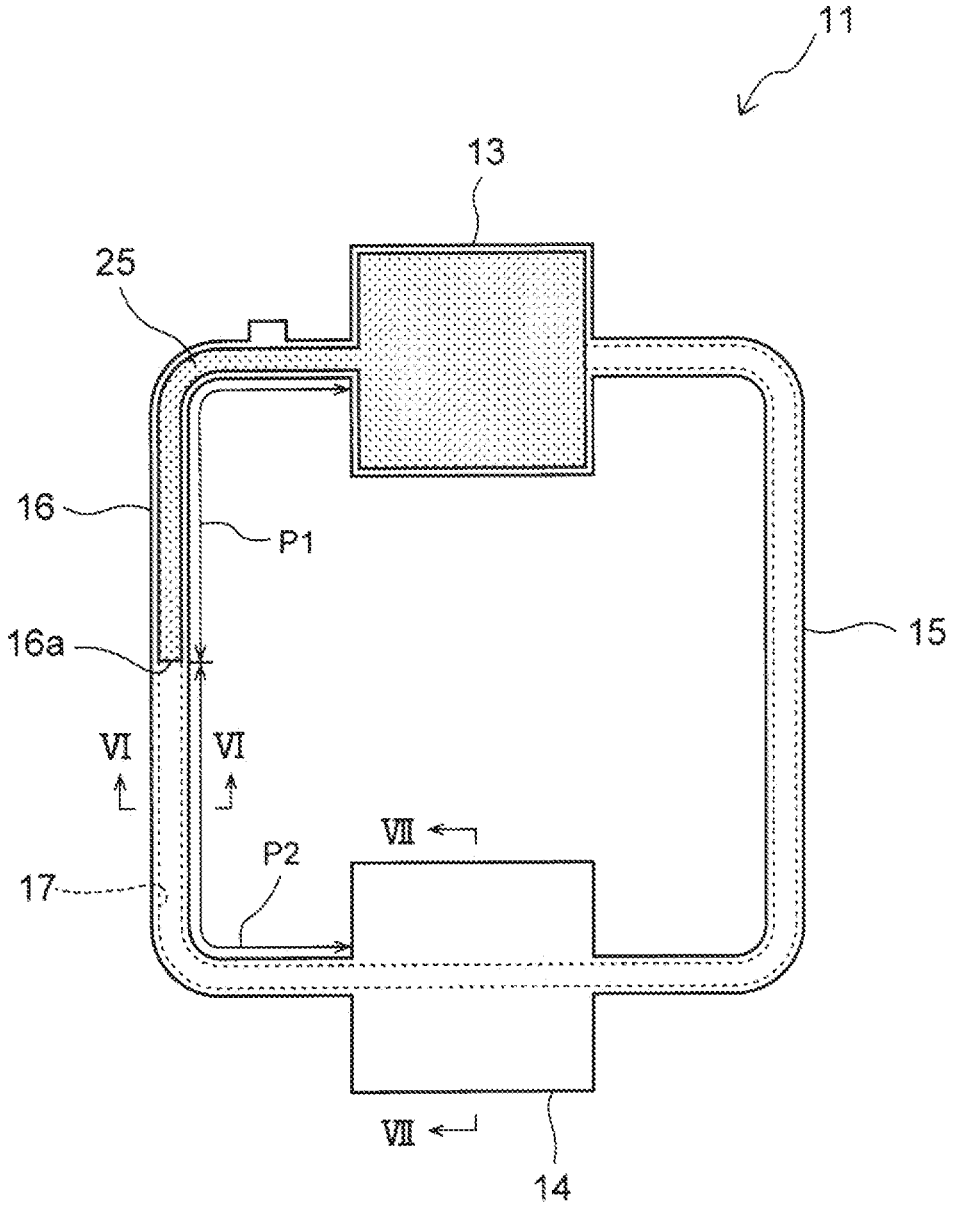
FIG. 9 is a plan view when the porous member is provided in only a portion of a liquid pipe in the first embodiment.

FIG. 9 is a plan view when the porous member 25 is provided in only the portion of the liquid pipe 16.

In the example of FIG. 9, the region of the liquid pipe 16 where the porous member 25 is provided is regarded as a portion P1 extending from a middle portion 16*a* of the liquid pipe 16 to the evaporator 13. The porous member 25 is not provided in the conduit 17 in a portion P2 of the liquid pipe 16 extending from the middle portion 16*a* to the condenser 14.

Figure 10A:
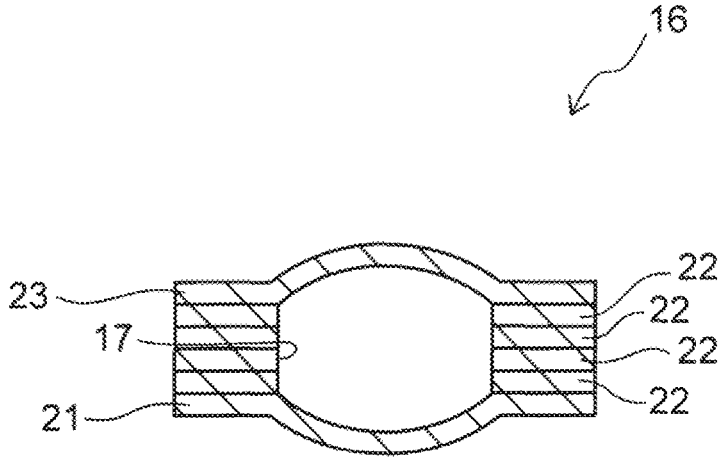
FIG. 10A is a sectional view of the liquid pipe taken along a line VI-VI of FIG. 9.

FIG. 10A is a sectional view of the portion P2 of the liquid pipe 16 taken along a line VI-VI of FIG. 9.

The porous member 25 that restricts outward expansion of the metal layers 21 and 23 is absent from the portion P2. Accordingly, as long as the liquid pipe 16 does not contact the electronic component 19 (see FIG. 3), it is preferable that the lower-side metal layer 21 and the upper-side metal layer 23 are expanded as in FIG. 10A to thereby reduce the resistance the working fluid C receives from the liquid pipe 16.

Figure 10B:
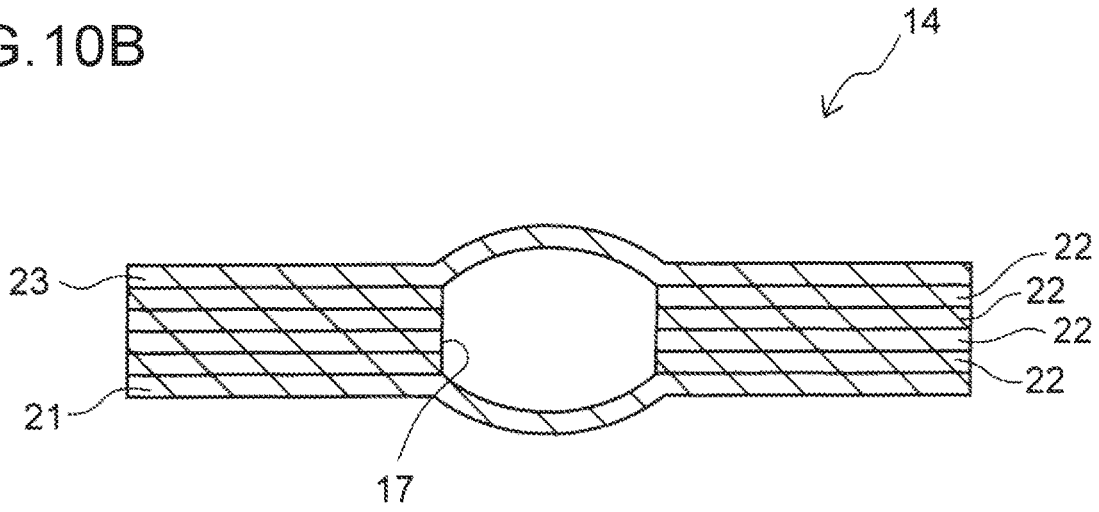
FIG. 10B is a sectional view of a condenser taken along a line VII-VII of FIG. 9.

FIG. 10B is a sectional view of the condenser 14 taken along a line VII-VII of FIG. 9.

The porous member 25 is also absent from the condenser 14. Therefore, it is preferable that the lower-side metal layer 21 and the upper-side metal layer 23 are expanded to thereby reduce the resistance the working fluid C receives from the liquid pipe 16, as shown in FIG. 10B.

Incidentally, in order to accelerate cooling of the working fluid C in the condenser 14, the condenser 14 may be firmly fixed to the housing 12 to thereby release heat of the condenser 14 to the outside through the housing 12.

Figure 11:
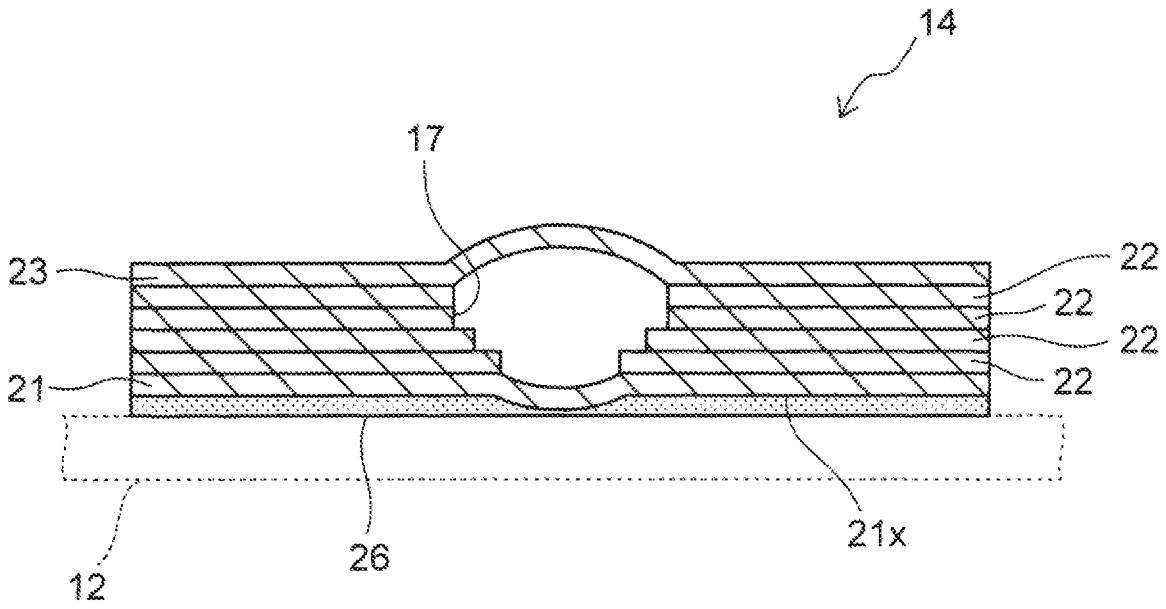
FIG. 11 is a sectional view of the condenser firmly fixed to a housing in the first embodiment.

FIG. 11 is a sectional view of the condenser 14 firmly fixed to the housing 12. FIG. 11 corresponds to the sectional view of the condenser 14 taken along the line VII-VII of FIG. 9.

In the example of FIG. 11, the housing 12 is firmly fixed to the outer-side surface 21*x* of the lower-side metal layer 21 through a TIM (Thermal Interface Material) 26 of a thermally conductive grease or resin etc. In addition, a structure in which the width of the conduit 17 is stepwise narrowed from the upper-side metal layer 23 toward the lower-side metal layer 21 is used in a similar manner to or the same manner as in FIG. 5 so as to suppress expansion of the lower-side metal layer 21. Thus, due to the reduction in unevenness of the outer-side surface 21*x* of the lower-side metal layer 21, close contact between the lower-side metal layer 1 and the housing 12 through the TIM 26 can be made excellent. Consequently, the heat of the condenser 14 can be efficiently released to the outside through the housing 12.

Incidentally, when the TIM 26 can absorb the unevenness of the outer-side surface 21*x* satisfactorily, the expansion of the lower-side metal layer 21 may be not suppressed in this manner, but the housing 12 may be firmly fixed to the lower metal layer 21 that is expanded largely toward the lower side as in FIG. 10B.

According to the present embodiment as described above, the lower-side metal layer 21 or the upper-side metal layer 23 is expanded to reduce the resistance the working fluid C receives from the conduit 17. In addition, since the section of the conduit 17 is formed into a stepwise shape, the expansion of the lower-side metal layer 21 or the upper-side metal layer 23 is suppressed in the region where the electronic component 19 and the loop type heat pipe 11 are adjoined to each other.

The region where the lower-side metal layer 21 or the upper-side metal layer 23 is expanded is not limited particularly as long as it is a region where the loop type heat pipe 11 does not contact the electronic component 19. A portion of any of the condenser 14, the liquid pipe 16 and the vapor pipe 15 can be such a region. Incidentally, since deformation of the lower-side metal layer 21 and the upper-side metal layer 23 in the evaporator 13 is restricted by the porous member 25 (see FIG. 8) or the heat-generating component 18, the lower-side metal layer 21 and the upper-side metal layer 23 in the evaporator 13 do not have to be warped forcibly.

The present inventor examined how much heat transport performance of the loop type heat pipe 11 could be improved when the lower-side metal layer 21 or the upper-side metal layer 23 was expanded thus.

Figure 12:
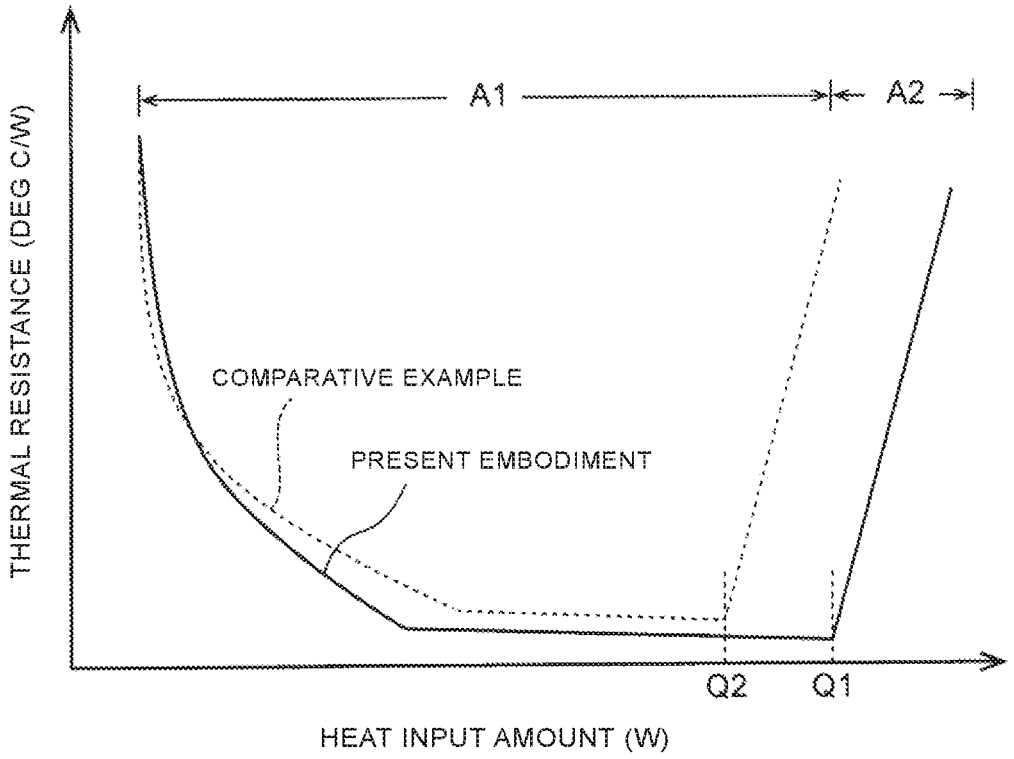
FIG. 12 is a graph obtained by examining heat transport performance of the loop type heat pipe according to the first embodiment.

A result of the examination is shown in FIG. 12.

FIG. 12 is a graph obtained as the examination result of the heat transport performance of the loop type heat pipe 11 according to the present embodiment. In FIG. 12, the abscissa indicates a heat input amount to the evaporator 13, and the ordinate indicates thermal resistance of the loop type heat pipe 11.

Incidentally, the examination result of the loop type heat pipe 1 shown in FIG. 1 is also shown as a comparative example in FIG. 12. In the loop type heat pipe 1 according to the comparative example, the conduit 9 is not expanded as described above with reference to FIG. 2.

The loop type heat pipe 11 according to the present embodiment operates normally in an operating area A1 in which the thermal resistance decreases with the increase of the heat input amount. On the other hand, the loop type heat pipe 11 according to the present embodiment malfunctions due to excessive pressure loss inside the conduit 17 in an inoperable area A2 where the heat input amount is larger than that in the operating area A1.

As shown in FIG. 12, the thermal resistance in the present embodiment is smaller than that in the comparative example in the most part of the operating area A1. This is conceived that the flow of the working fluid C inside the conduit 17 is smoother due to the conduit 17 expanded as in the present embodiment.

Moreover, a maximum value Q1 of the heat input amount with which the loop type heat pipe 11 can operate in the present embodiment is larger than a maximum value Q2 in the comparative example.

It has been confirmed from these results that the expansion of the conduit 17 as in the present embodiment is effective in increasing the heat transport performance of the loop type heat pipe 11.

Next, a manufacturing method of the loop type heat pipe 11 according to the present embodiment will be described.

Figure 13:
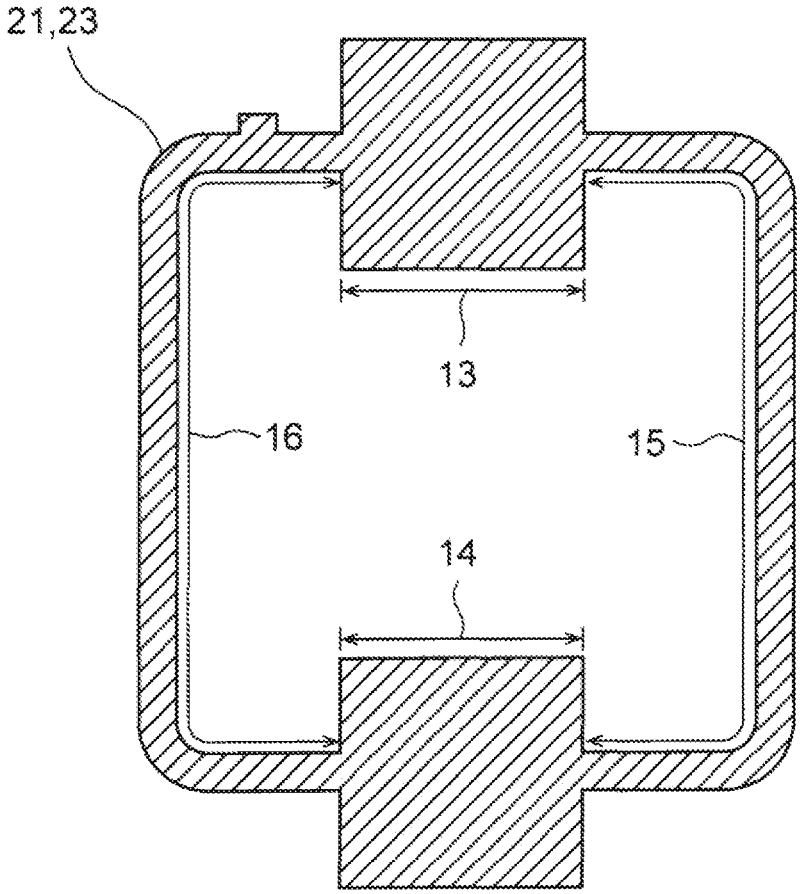
FIG. 13 is a plan view of each of a lower-side metal layer and an upper-side metal layer used in the loop type heat pipe according to the first embodiment.

FIG. 13 is a plan view of each of the lower-side metal layer 21 and the upper-side metal layer 23 used in the loop type heat pipe 11.

As shown in FIG. 13, each of the lower-side metal layer 21 and the upper-side metal layer 23 has a planar shape corresponding to each of the evaporator 13, the condenser 14, the vapor pipe 15 and the liquid pipe 16.

Figure 14:
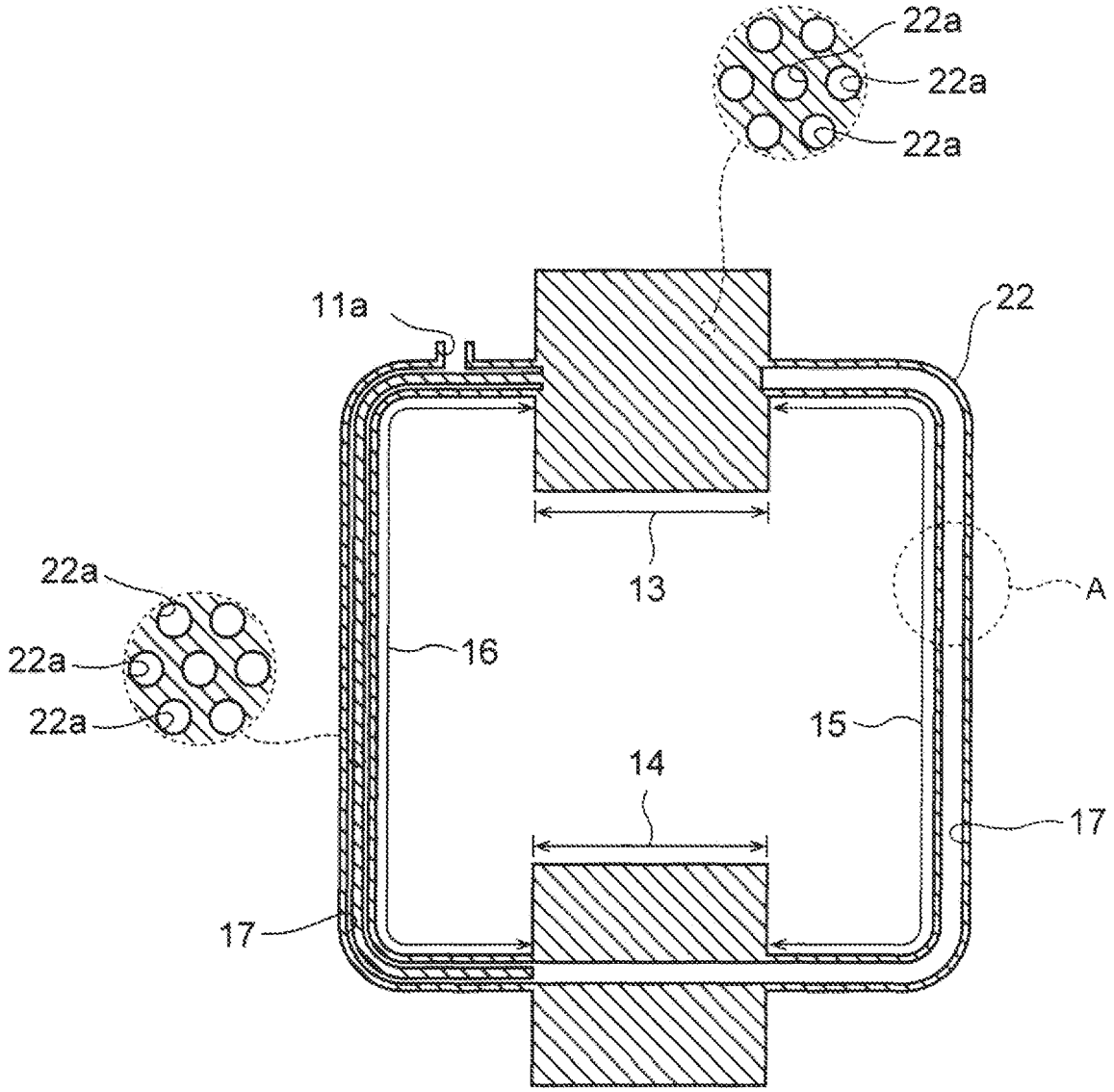
FIG. 14 is a plan view of intermediate metal layers used in the loop type heat pipe according to the first embodiment.

On the other hand, FIG. 14 is a plan view of the intermediate metal layers 22 used in the loop type heat pipe 11.

As shown in FIG. 4, the intermediate metal layers 22 also have a planar shape corresponding to each of the evaporator 13, the condenser 14, the vapor pipe 15 and the liquid pipe 16.

In addition, the conduit 17 is provided in the intermediate metal layers 22. The conduit 17 has a loop shape in plan view. An injection port 11*a* for injecting the working fluid C into the conduit 17 is formed in the intermediate metal layers 22. Further, a plurality of fine pores 22*a* forming the porous member 25 are opened in a portion of the intermediate metal layers 22 corresponding to the evaporator 13 and the liquid pipe 16.

Figure 15:
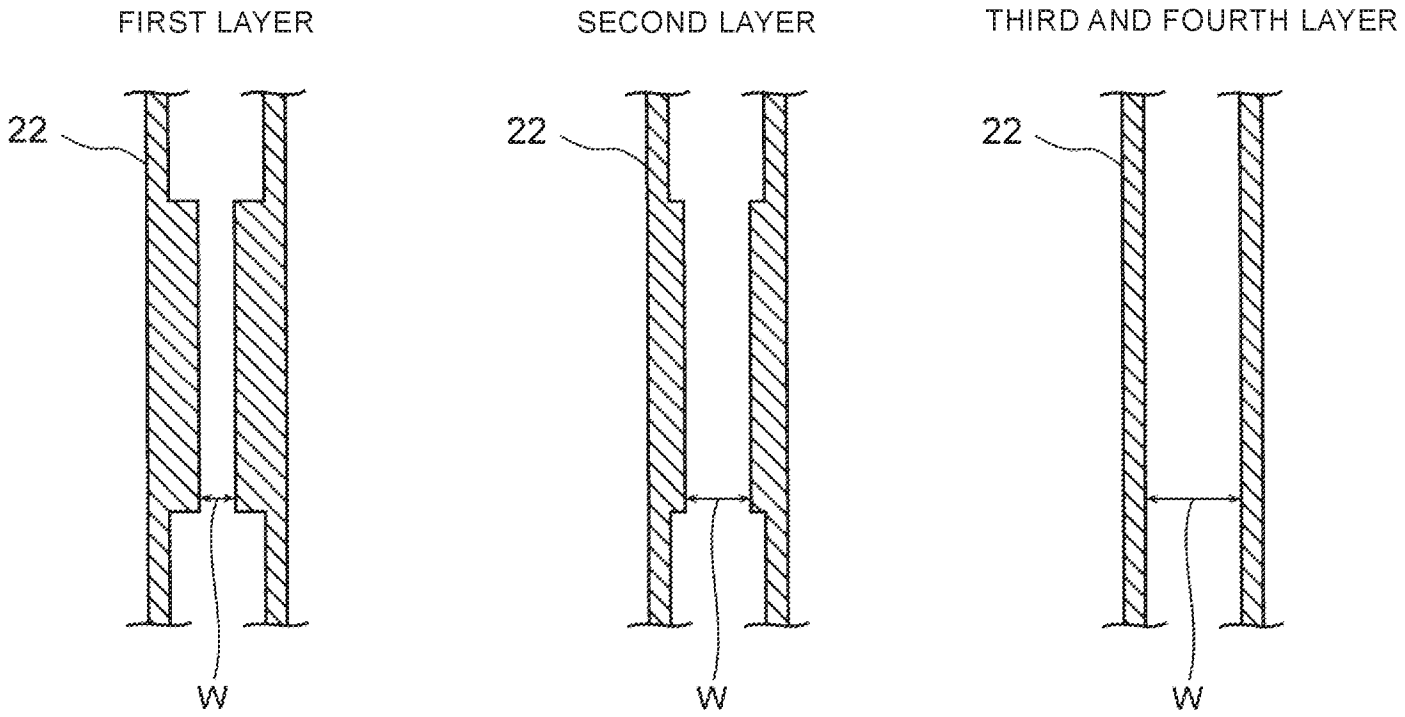
FIG. 15 is respective enlarged plan views of the intermediate metal layers in a region A of FIG. 14.

Incidentally, in an area A of FIG. 14, the conduit 17 and the electronic component 19 (see FIG. 3) overlap each other. FIG. 15 is respective enlarged plan views of the intermediate metal layers 22 in the area A.

As shown in FIG. 15, the width W of the conduit 17 is narrowest in the first intermediate metal layer 22 and wider in order of the second intermediate metal layer 22 and the third intermediate metal layer 22.

The aforementioned metal layers 21 to 23 are disposed on one another so that the loop type heat pipe 11 is manufactured. However, the manufacturing method of the loop type heat pipe 11 includes a first example and a second example as follows.

First Example

Figure 16A:
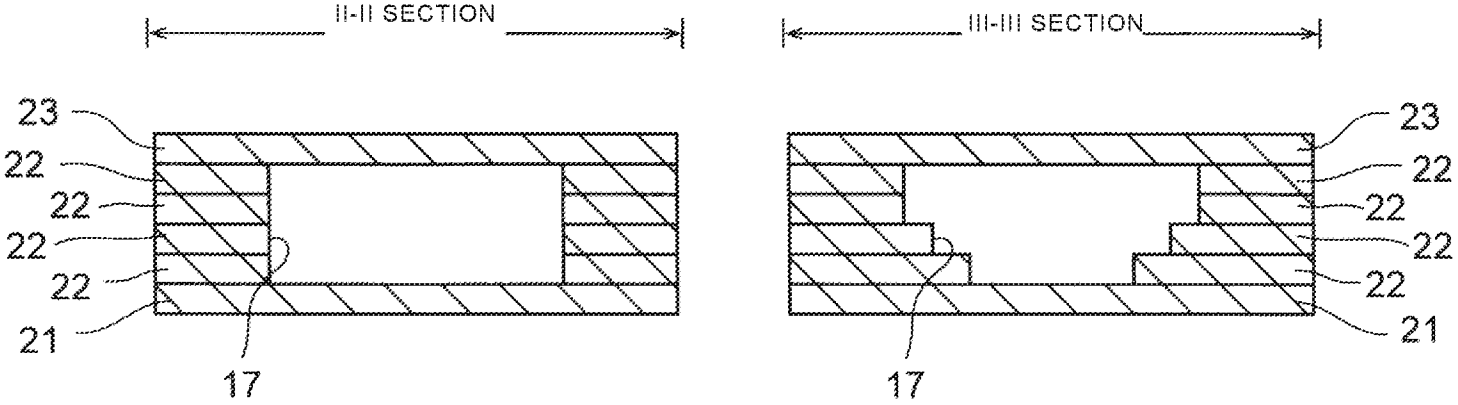
FIGS. 16A and 16B are sectional views in the middle of manufacturing a loop type heat pipe according to a first example of the first embodiment (Part 1)
Figure 16B:
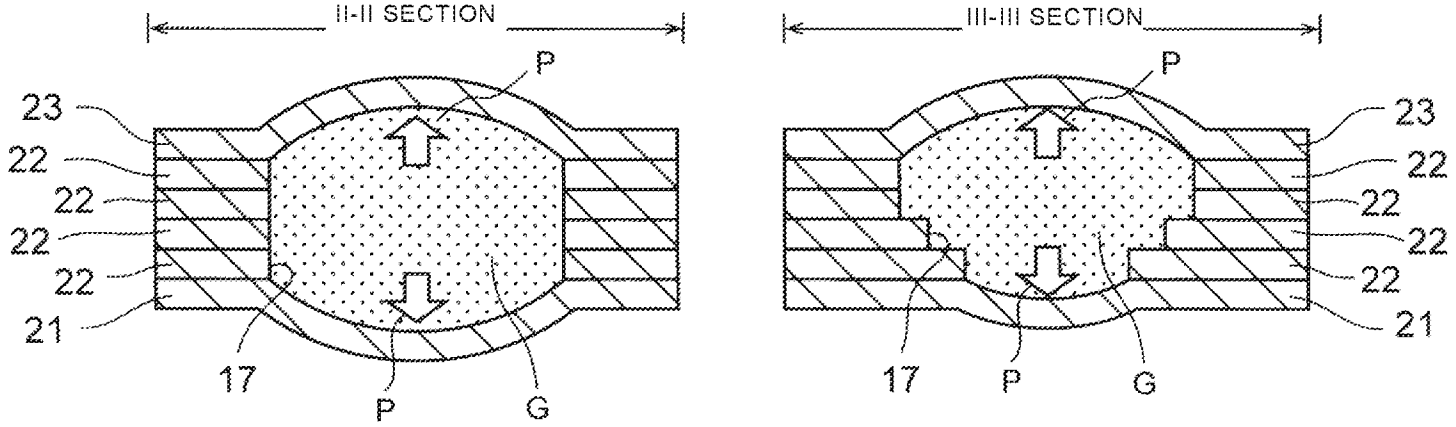
Figure 17:
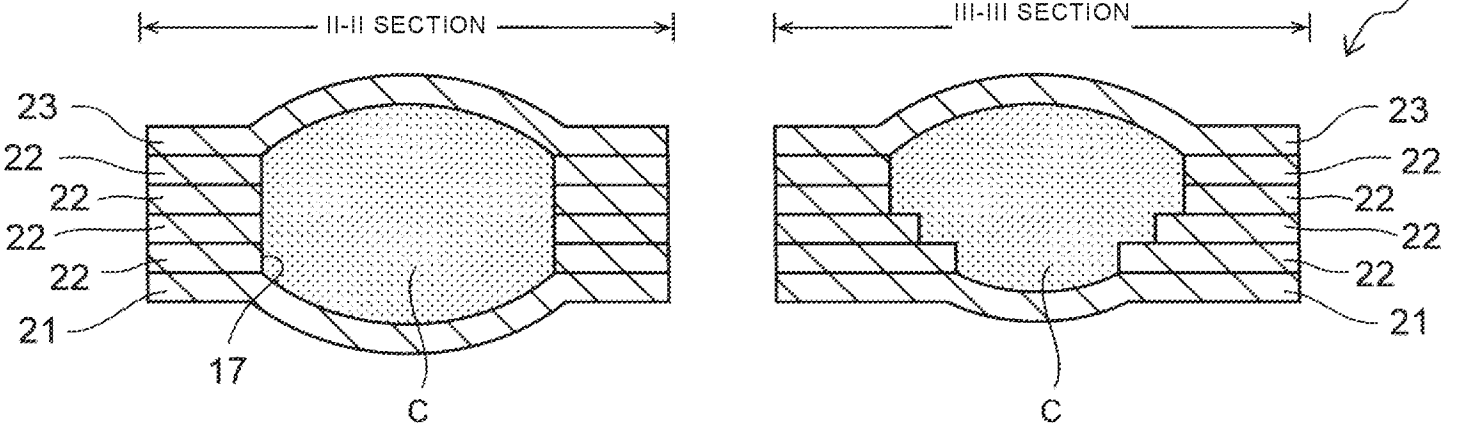
FIG. 17 is sectional views in the middle of manufacturing the loop type heat pipe according to the first example of the first embodiment (Part 2)

FIGS. 16A and 16B and FIG. 17 are sectional views in the middle of manufacturing the loop type heat pipe 11 according to the first example.

Incidentally, the sections taken along the line II-II and the line III-III of FIG. 3 respectively are also shown in FIGS. 16A and 16B and FIG. 17.

First, as shown in FIG. 16A, the aforementioned lower-side metal layer 21, the aforementioned intermediate metal layers 22 and the aforementioned upper-side metal layer 23 are disposed on one another in the named order. While being heated to a temperature of 500° C. or higher, e.g. to a temperature of 700° C., the respective metal layers 21 to 23 are pressed by pressure of about 10 MPa so that the respective metal layers 21 to 23 are bonded to one another by diffusion bonding. Consequently, the conduit 17 is closed by the lower-side metal layer 21 and the upper-side metal layer 23 from above and below.

The conduit 17 is substantially shaped like a rectangle in the section taken along the line II-II, whereas the conduit 17 has stepwise side surfaces between which a width is narrowed toward the lower-side metal layer 21 in the section taken along the line III-III.

In addition, since the respective metal layers 21 to 23 are disposed on one another in this manner, each of the aforementioned evaporator 13, the aforementioned condenser 14, the aforementioned vapor pipe 15, and the aforementioned liquid pipe 16 is formed by the assembly of the disposed metal layers 21 to 23.

Next, as shown in FIG. 16B, gas G with higher pressure than atmospheric pressure is introduced from the injection port 11*a* (see FIG. 14) into the conduit 17 while the assembly of the disposed metal layers 21 to 23 is maintained at room temperature. Thus, each of the lower-side metal layer 21 and the upper-side metal layer 23 is plastically deformed by the pressure P of the gas G. Consequently, each of the metal layers 21 and 23 warps toward the outside of the conduit 17. Air with pressure of 0.5 MPa is used as the gas G in the present embodiment.

In addition, in the section taken along the line III-III, the width of the conduit 17 is narrowed as going closer to the lower-side metal layer 21. Accordingly, the warp of the lower-side metal layer 21 is suppressed.

Next, as shown in water is injected as the working fluid C from the injection port 11*a* into the conduit 17. Then, the injection port 11*a* is sealed. Accordingly, the working fluid is enclosed in the conduit 17.

In the aforementioned manner, the loop type heat pipe 11 according to the present embodiment is completed.

According to the manufacturing method of the loop type heat pipe 11 according to the present example, the lower-side metal layer 21 and the upper-side metal layer 23 can be easily warped by the pressure of the gas G without applying mechanical working onto the metal layer 21 or the metal layer 23.

Second Example

Figure 18A:
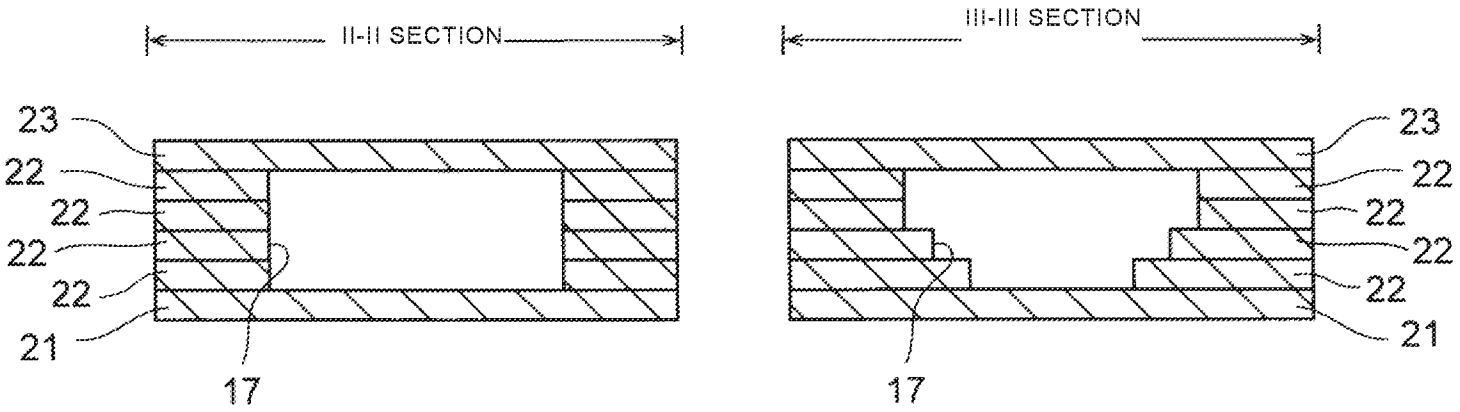
FIGS. 18A and 18B are sectional views in the middle of manufacturing a loop type heat pipe according to a second example of the first embodiment (Part 1)
Figure 18B:
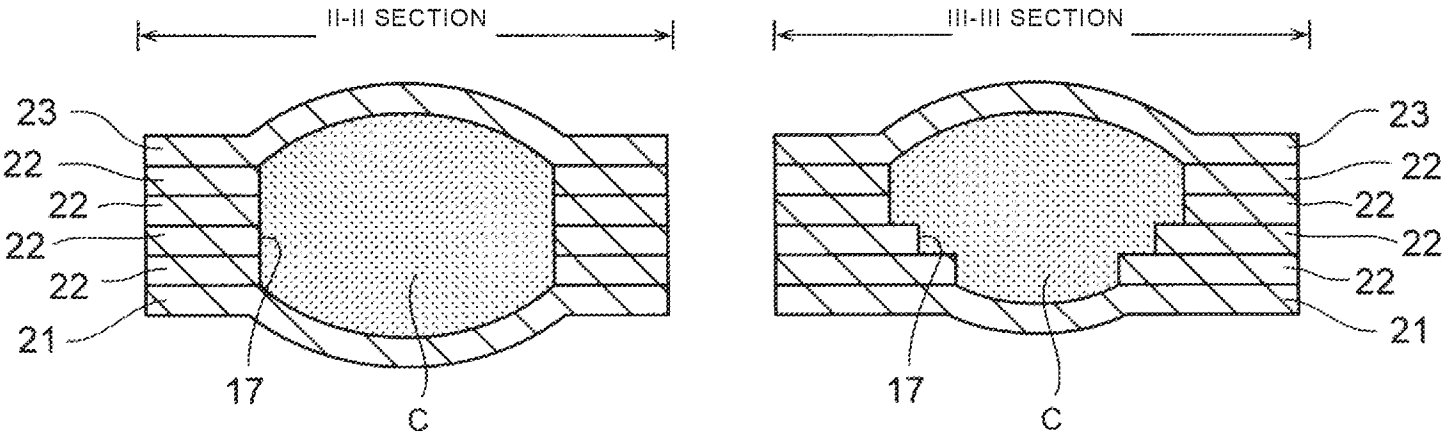
Figure 19:
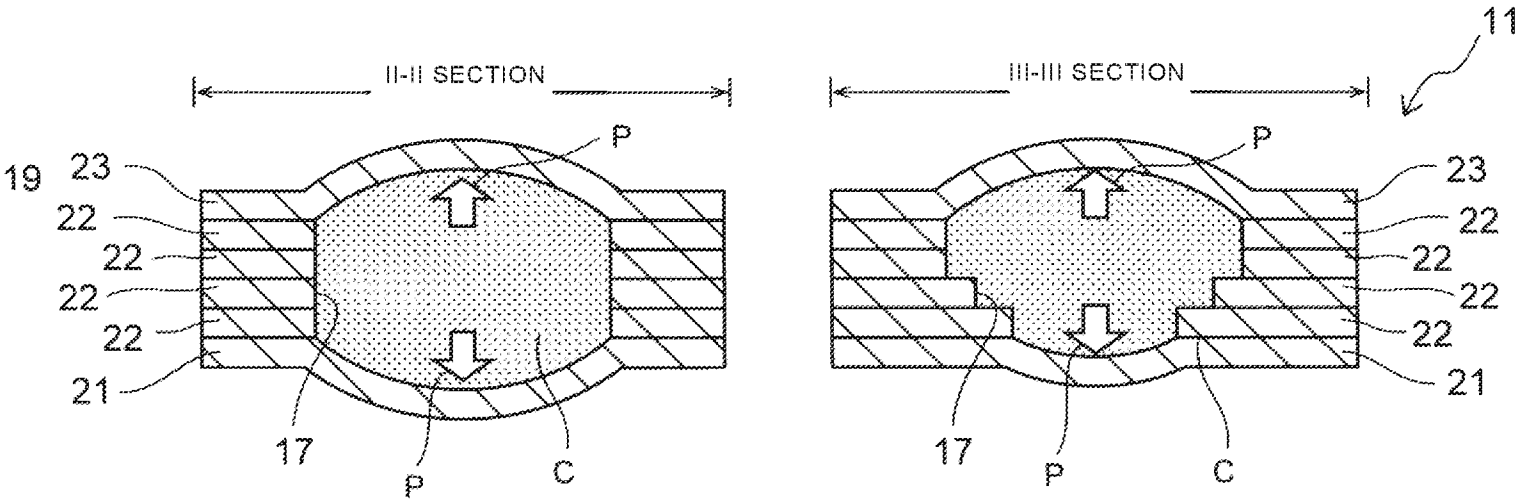
FIG. 19 is sectional views in the middle of manufacturing the loop type heat pipe according to the second example of the first embodiment (Part 2)

FIGS. 18A and 18B and FIG. 19 are sectional views in the middle of manufacturing a loop type heat pipe 11 according to a second example. The sections taken along the linen-II and the line III-III of FIG. 3 respectively are also shown in FIGS. 18A and 18B and FIG. 19 in the same manner as in FIGS. 16A and 16B and FIG. 17.

First, as shown in FIG. 18A, respective metal layers 21 to 23 are pressed while heated in the same manner as in FIG. 16A. Thus, the metal layers 21 to 23 are bonded to one another by diffusion bonding.

Next, as shown in 18B, water is injected as a working fluid C from an injection port 11*a* (see FIG. 14) into a conduit 17. Then, the injection port 11*a* is sealed. Accordingly, the working fluid C is enclosed in the conduit 17.

As shown in FIG. 19, the working fluid C is heated to a temperature of about 200° higher than a boiling point of the working fluid C from the outside of the conduit 17 so that the working fluid C is vaporized. Thus, the lower-side metal layer 21 and the upper-side metal layer 23 are plastically deformed respectively by pressure P of the vaporized working fluid C so that each of the metal layers 21 and 23 can be warped toward the outside of the conduit 17.

On this occasion, in the section taken along the line III-III, the warp of the lower-side metal layer 21 is suppressed in the same manner as in the first example.

In the aforementioned manner, the loop type heat pipe 11 according the present embodiment is completed.

According to the manufacturing method of the loop type heat pipe 11 according to the present example, the lower-side metal layer 21 or the upper-side metal layer 23 is warped by the pressure of the vaporized working fluid C. Accordingly, a process of injecting special gas for warping the metal layers into the conduit 17 can be omitted so that the entire process can be simplified.

Next, various modifications of the present embodiment will be described.

First Modification

Figure 20:
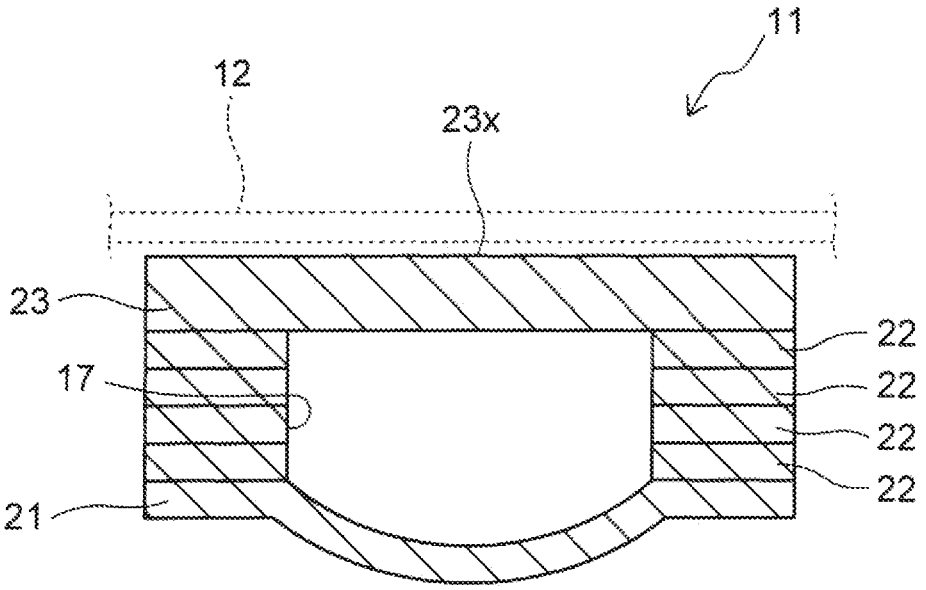
FIG. 20 is a sectional view of a loop type heat pipe in a first modification of the first embodiment.

FIG. 20 is a sectional view of a loop type heat pipe 11 in a first modification. FIG. 20 corresponds to the sectional view taken along the line II-II of FIG. 3.

As shown in FIG. 20, an upper-side metal layer 23 is formed with a thickness of about 200 μm in the present modification so that the thickness of the upper-side metal layer 23 is made thicker than a thickness (100 μm) of a lower-side metal layer 21. Thus, when pressure inside the conduit 17 is increased in the process of FIG. 16B or FIG. 19, the lower-side metal layer 21 is apt to warp outward by the pressure, but the upper-side metal layer 23 that is too thick to be plastically deformed is hard to warp so that an outer-side surface 23*x* of the upper-side metal layer 23 can be kept flat.

Accordingly, even when the upper-side metal layer 23 and a housing 12 are located in proximity to each other so that there is no space therebetween to allow the upper-side metal layer 23 to warp, only the lower-side metal layer 21 can be selectively warped while the upper-side metal layer 23 is prevented from contacting the housing 12.

Incidentally, the upper-side metal layer 23 is made thicker than the lower-side metal layer 21 in the example of FIG. 20, However, the lower-side metal layer 21 may be made thicker than the upper-side metal layer 23 contrary to the example of FIG. 20.

Figure 21:
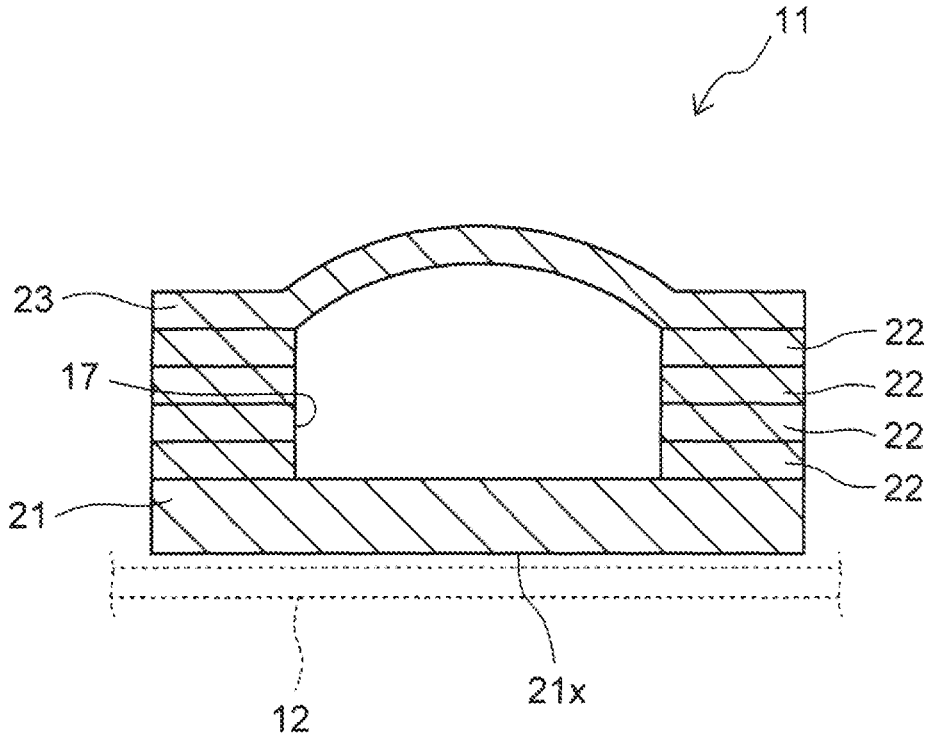
FIG. 21 is a sectional view when a lower-side metal layer is made thicker than an upper-side metal layer in the first modification of the first embodiment.

FIG. 21 is a sectional view of this case.

In this case, the warp of the lower-side metal layer 21 is suppressed so that an outer-side surface 21*x* of the lower-side metal layer 21 can be flat. Accordingly, the housing 12 can be located in proximity to the bottom of the lower-side metal layer 21.

Second Modification

Figure 22:
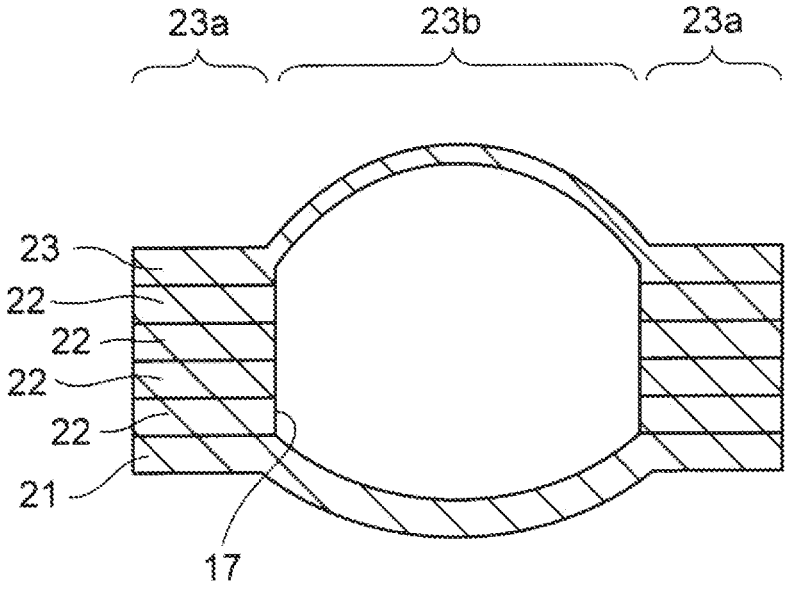
FIG. 22 is a sectional view of a loop type heat pipe in a second modification of the first embodiment.

FIG. 22 is a sectional view of a loop type heat pipe 11 in a second modification. FIG. 22 corresponds to the sectional view taken along the line of FIG. 3.

As shown in FIG. 22, an upper-side metal layer 23 in the present modification has bonding portions 23*a* each of which is bonded to intermediate metal layers 22, and a pipe wall portion 23*b* that faces a conduit 17. In the present modification, the pipe wall portion 23*b* is also made thinner in thickness than each of the bonding portions 23*a* in the present modification.

Thus, when pressure inside the conduit 17 is increased in the process of FIG. 16B or FIG. 19, the pipe wall portion 23*b* can be warped largely toward the outside by the pressure.

Incidentally, the pipe wall portion 23*b* may be wet-etched while the bonding portions 23*a* are covered with a not-shown resist mask. Thus, the pipe wall portion 23*b* can be made thinner than each of the bonding portions 23*a*.

In addition, the pipe wall portion 23*b* of the upper-side metal layer 23 is made thinner in the example of FIG. 22. However, a lower-side metal layer 21 may be made thinner contrary to the example of FIG. 22.

Figure 23:
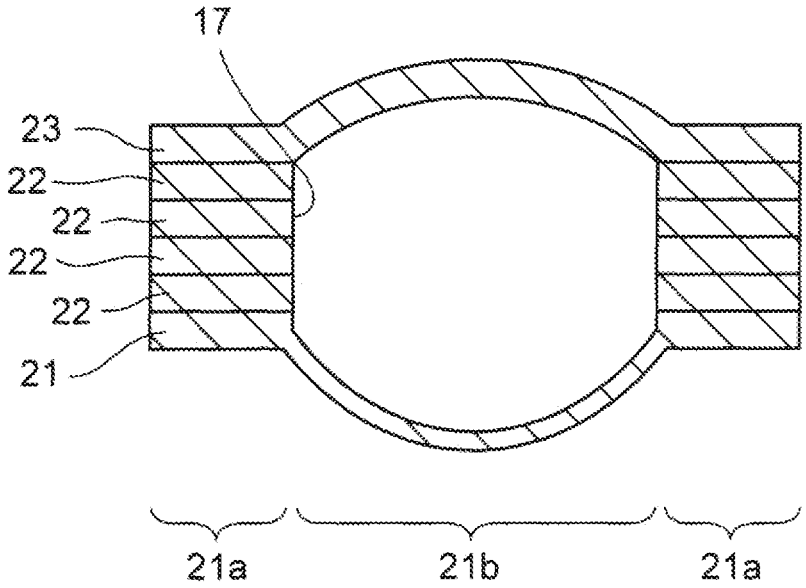
FIG. 23 is a sectional view when a pipe wall portion of the lower-side metal layer is made thinner than a bonding portion of the same in the second modification of the first embodiment.

FIG. 23 is a sectional view of this case.

In this case, of the lower-side metal layer 21, a pipe wall portion 21*b* facing the conduit 17 is made thinner in thickness than each of bonding portions 21*a* bonded to the intermediate metal layers 22. Thus, the lower-side metal layer 21 is apt to warp largely toward the outside of the conduit 17.

Second Embodiment

In the first embodiment, at least one of the lower-side metal layer 21 and the upper-side metal layer 23 is warped. Thus, the resistance the working fluid receives from the conduit 17 can be reduced. However, the conduit 17 may rupture during a reliability test applied to the loop type heat pipe 11. For example, a thermal shock test can be such a reliability test. The thermal shock test is a test in which cooling and heating of the loop type heat pipe 11 are performed repeatedly. The conduit 17 may rupture when the working fluid C repeatedly changes its phase between a liquid phase and a vapor phase during the test.

To solve this problem, the possibility that the conduit 17 may rupture can be reduced in the following manner in the present embodiment.

Figure 24A:
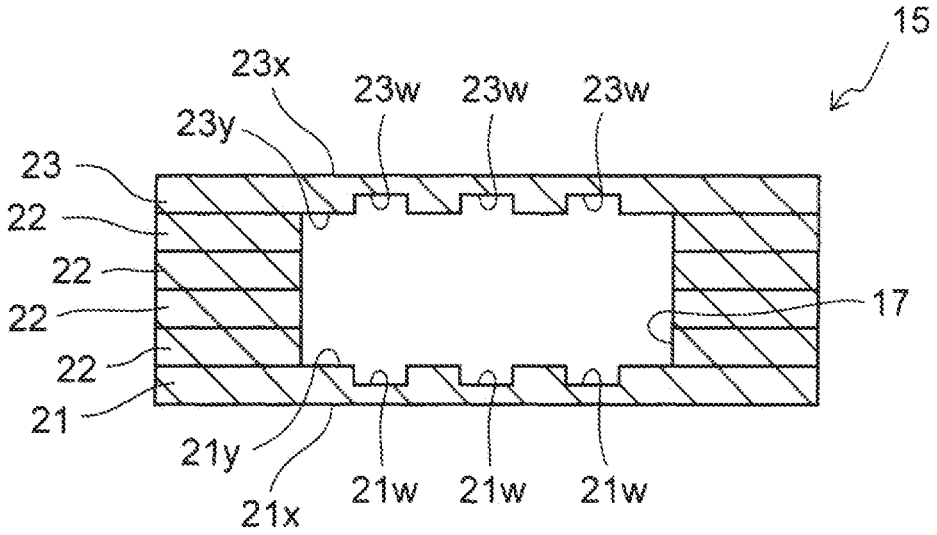
FIG. 24A is a sectional view of a vapor pipe before a lower-side metal layer and an upper-side metal layer are warped toward the outside of a conduit in a second embodiment.

FIG. 24A is a sectional view of a vapor pipe 15 before metal layers 21 and 23 are warped toward the outside of a conduit 17 respectively.

As shown in FIG. 24A, each of the metal layers 21 and 23 has an inner-side surface 21*y*, 23*y* facing the conduit 17, and an outer-side surface 21*x*, 23*x* opposite to the inner-side surface 21*y*, 23*y*. In the present embodiment, recesses 21*w*, 23*w* are formed in each of the inner-side surfaces 21*y* and 23*y*.

Figure 24B:
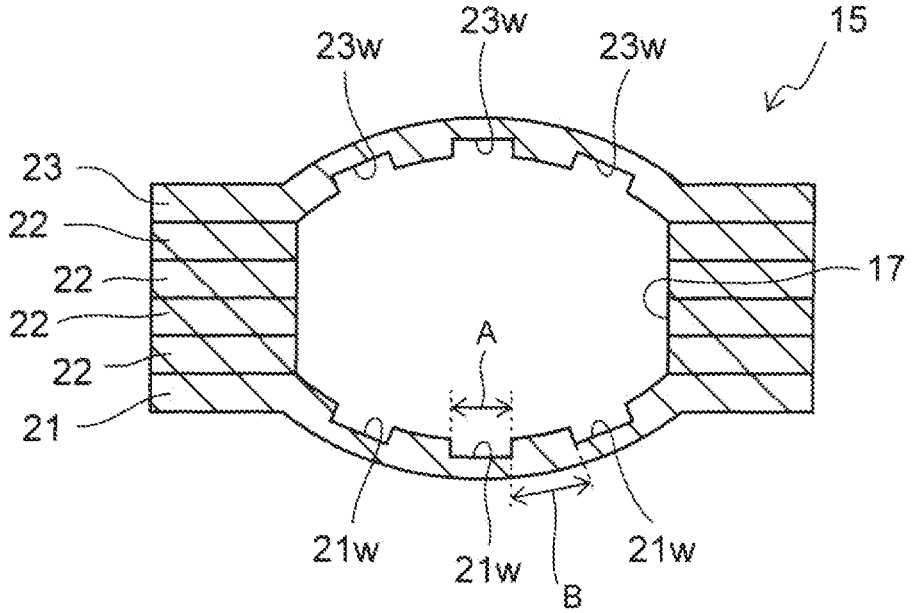
FIG. 24B is a sectional view of the vapor pipe after the lower-side metal layer and the upper-side metal layer are warped toward the outside of the conduit in the second embodiment.

FIG. 24B is a sectional view of the vapor pipe 15 after the side metal layer 21 and the upper-side metal layer 23 are warped toward the outside of the conduit 17 in the process of FIG. 16B or FIG. 19 in the first embodiment.

In the present embodiment, the recesses 21*w*, 23*w* are formed in each of the lower-side metal layer 21 and the upper-side metal layer 23 in the aforementioned manner. Accordingly, it is easy to plastically deform each of the metal layers 21 and 23 so that it is easy to warp the metal layers 21 and 23 outward.

Moreover, since a thickness of each of the metal layers 21 and 23 in portions where the recesses 21*w* and 23*w* are not formed is maintained, the possibility that the metal layers 21 and 23 may rupture during the warp can be also reduced.

Incidentally, the recesses 21*w*, 23*w* are formed in each of the lower-side metal layer 21 and the upper-side metal layer 23 in this example. However, the recesses 21*w*, 23*w* may be formed in only one of the lower-side metal layer 21 and the upper-side metal layer 23.

In addition, the size of each of the recesses 21*w* is not limited particularly. In this example, the width A of the recess 21W is set at about 1 mm, and the interval B between adjacent ones of the recesses 21*w* is set at about 1 mm. In addition, the depth of each of the recesses 21*w* is set at about 30 μm to about 60 μm. The width, interval and depth of the recesses 23*w* are the same as those of the recesses 21*w*.

Figure 25:
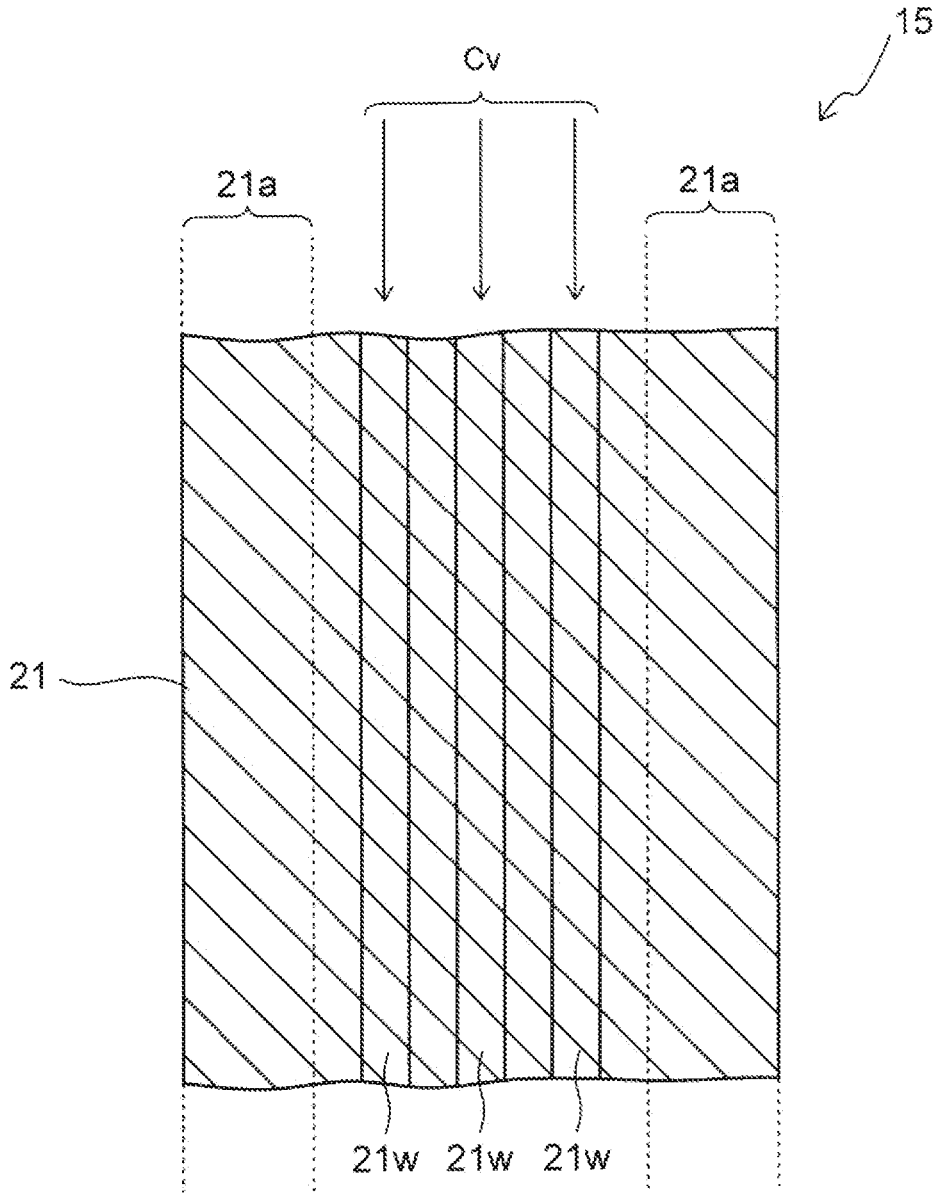
FIG. 25 is a plan view for explaining a plan shape of each of recesses in the second embodiment.

FIG. 25 is a plan view for explaining a planar shape of each of the recesses 21*w*.

As shown in FIG. 25, the recess 21*w* is a stripe-shaped groove extending along a flow direction of vapor Cv in plan view. Thus, the recess 21*w* functions as a guide groove for guiding the vapor Cv along a vapor pipe 15. Accordingly, the flow of the vapor Cv in the vapor pipe 15 can be smooth.

The recess 21*w* is not formed in each of bonding portions 21*a*. Thus, a contact area between the bonding portion 21*a* and the intermediate metal layers 22 (see FIG. 24B) is secured. Consequently, bonding strength between the bonding portion 21*a* and the intermediate metal layers 22 can be maintained.

In addition, each of the recesses 23*w* also has the same planar shape as the recess 21*w*. Description of the recess 23*w* will be therefore omitted.

A region where the respective recesses 21*w* and 23*w* are formed is not limited to the vapor pipe 15.

Figure 26:
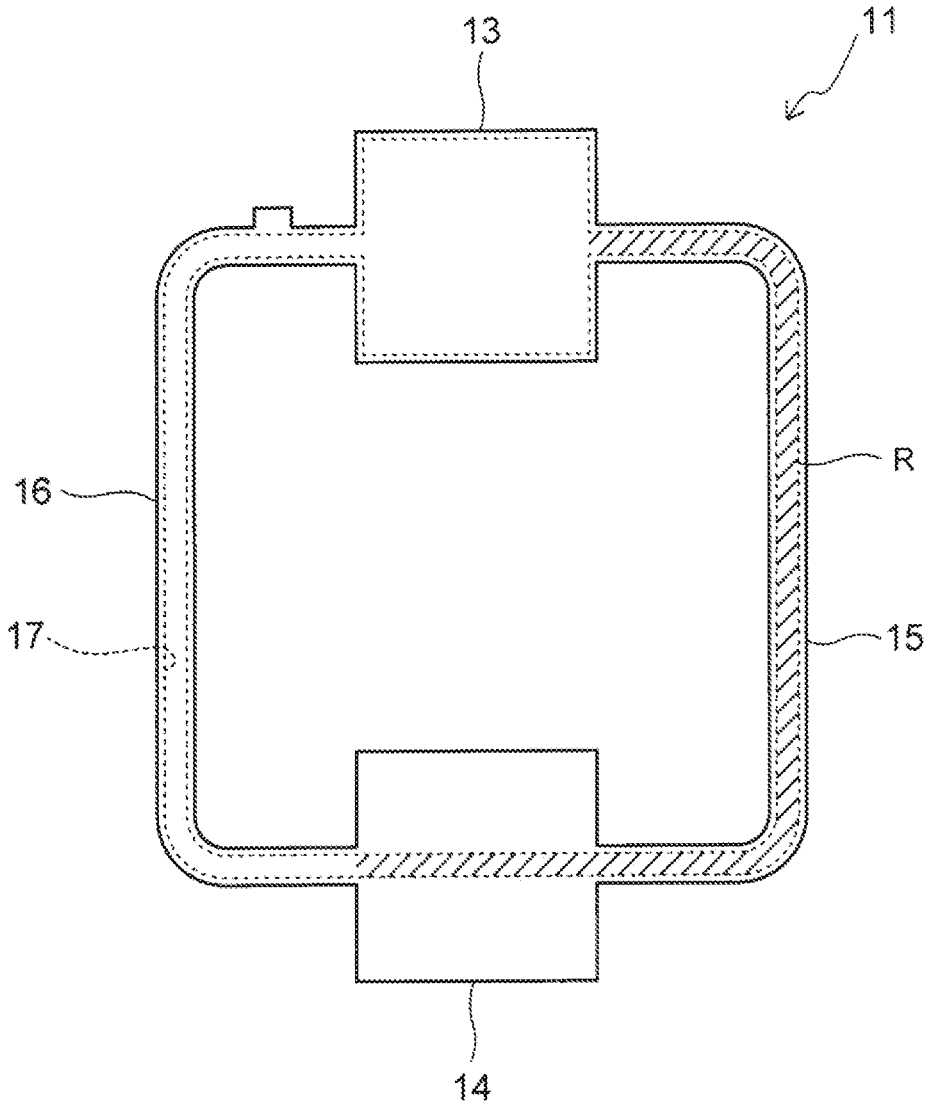
FIG. 26 is a plan view showing a region where the recesses are formed in a loop type heat pipe according to the second embodiment.

FIG. 26 is a plan view showing a region R where the respective recesses 21*w* and 23*w* are formed in a loop type heat pipe 11.

As shown in FIG. 26 the region R extends from the vapor pipe 15 to a condenser 14. Due to the respective recesses 21*w* and 23*w* that are also formed thus in the condenser 14, it is possible to easily warp each of the metal layers 21 and 23 in the condenser 14 while maintaining the strength of the metal layer 21, 23.

Incidentally, when the conduit 17 and another component may contact each other in the condenser 14, the recesses 21*w*, 23*w* may be omitted in each of the metal layers 21 and 23 in the condenser 14 so as to prevent the conduit 17 in the condenser 14 from being warped.

Next, a machining method of the lower-side metal layer 21 in the present embodiment will be described. Since a machining method of the upper-side metal layer 23 is also the same as the machining method of the lower-side metal layer 21, the machining method of the upper-side metal layer 23 will not be described below.

Figure 27A:
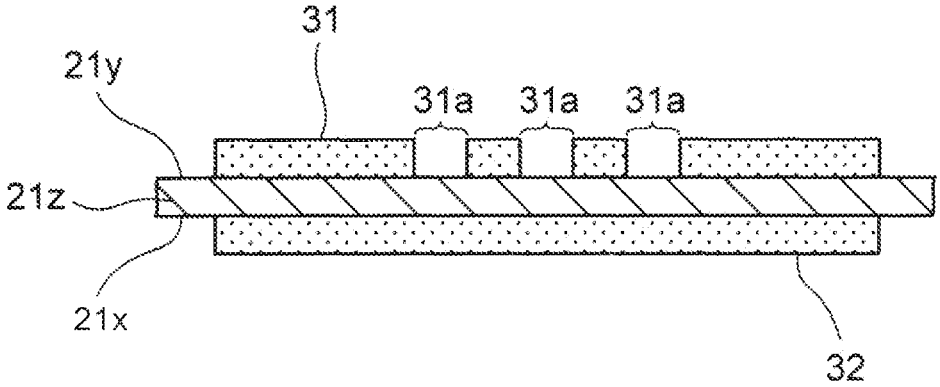
FIGS. 27A to 27C are sectional views for explaining a machining method of the lower-side metal layer according to the second embodiment.
Figure 27B:
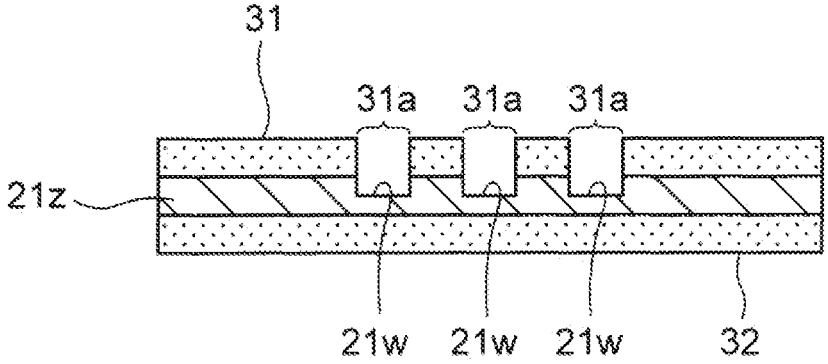
Figure 27C:
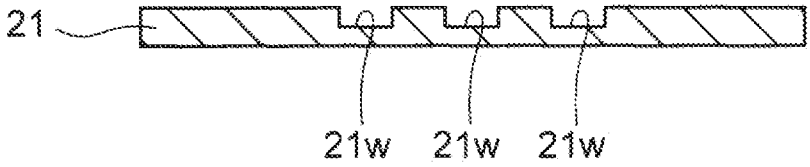

FIGS. 27A to 27C are sectional views for explaining the machining method of the lower-side metal layer 21 according to the present embodiment.

First, as shown in FIG. 27A, a metal layer 21*z* that is a copper layer is prepared. A first resist layer 31 is formed on an inner-side surface 21*y* of the metal layer 21*z* and a second resist layer 32 is formed on an outer-side surface 21*x* of the metal layer 21*z*. In here, resist openings 31*a* corresponding to the aforementioned recesses 21*w* are formed in the first resist layer 31.

Next, as shown in FIG. 27B, the metal layer 21*z* is wet-etched from its opposite surfaces with the resist layers 31 and 32 as masks.

Thus, recesses 21$w$ are formed in the metal layer 21$z$ under the resist openings 31$a$, and portions of the metal layer 21$z$ that are not covered with any of the resist layers 31 and 32 are removed by the wet etching.

Then, the resist layers 31 and 32 are removed so that the basic structure of the lower-side metal layer 21 can be obtained, as shown in FIG. 27C.

The present embodiment is not limited to the aforementioned one. Various modifications of the present embodiment will be described below.

First Modification

Figure 28:
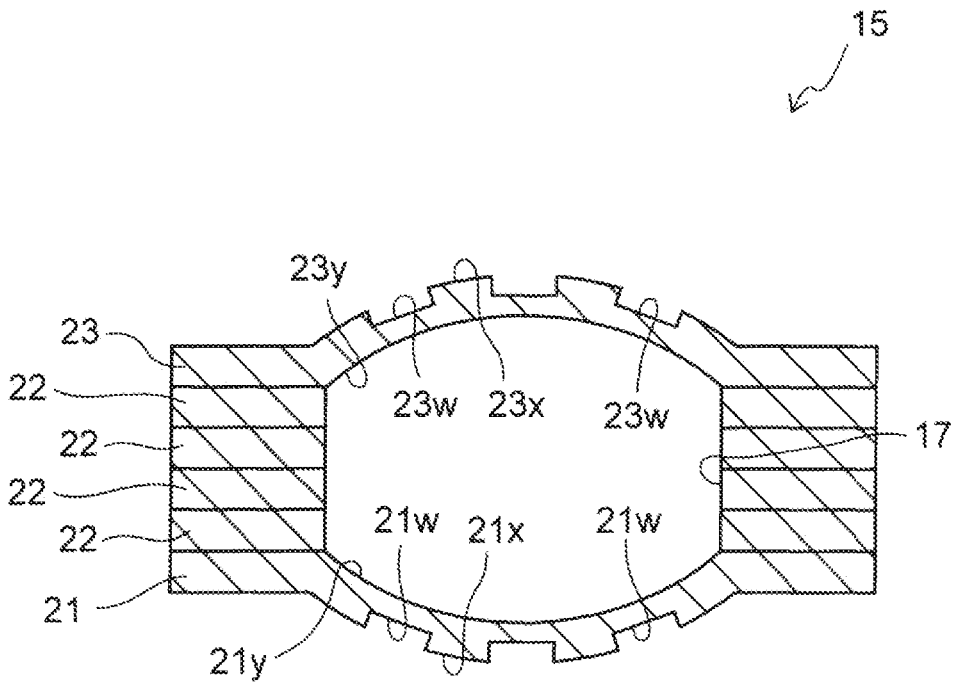
FIG. 28 is a sectional view of a vapor pipe according to a first modification of the second embodiment.

FIG. 28 is a sectional view of a vapor pipe 15 according to a first modification.

In the present modification, recesses 21$w$ and 23$w$ are formed in outer-side surfaces 21$x$ and 23$x$ of metal layers 21 and 23 respectively. Thus, the metal layers 21 and 23 can be easily warped toward the outside of a conduit 17 in the same manner as in the example of FIG. 24B. At the same time, the metal layers 21 and 23 can be prevented from rupturing during the warp while the thickness of each of the metal layers 21 and 23 in portions where the recesses 21$w$, 23$w$ are not formed is maintained.

Moreover, since respective inner-side surfaces 21$y$ and 23$y$ of the metal layers 21 and 23 are smooth, pressure loss of vapor Cv flowing through the inside of the vapor pipe 15 can be also reduced.

Second Modification

Figure 29:
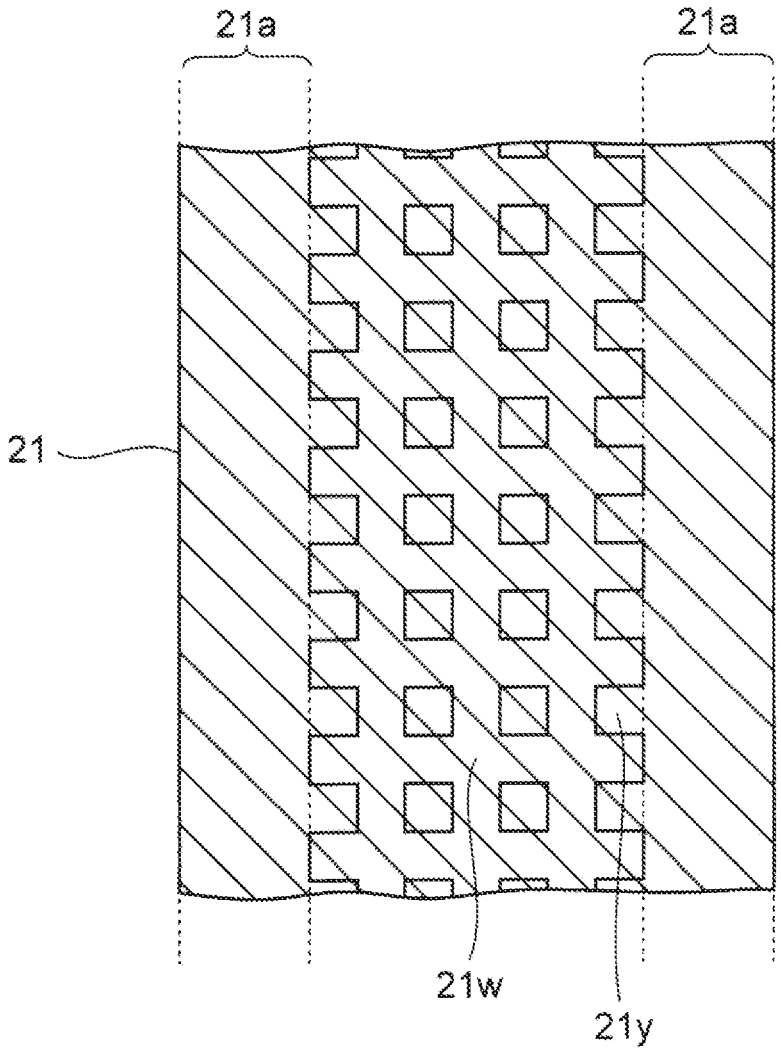
FIG. 29 is an enlarged plan view of a lower-side metal layer according to a second modification of the second embodiment.

FIG. 29 is an enlarged plan view of a lower-side metal layer 21 according to a second modification.

In this example, recesses 21$w$ formed in an inner-side surface 21$y$ of the lower-side metal layer 21 are arranged in a lattice pattern in plan view. In this manner, the lower-side metal layer 21 is plastically deformed more easily than that in the case where the recesses 21$w$ are formed into stripes as in FIG. 25. As a result, a conduit 17 is warped more easily.

Incidentally, since the planar shape of each of the recesses 23$w$ formed in the upper-side metal layer 23 is also the same as the planar shape of each of the recesses 21$w$, the description of the recess 23$w$ will be omitted.

Third Modification

Figure 30:
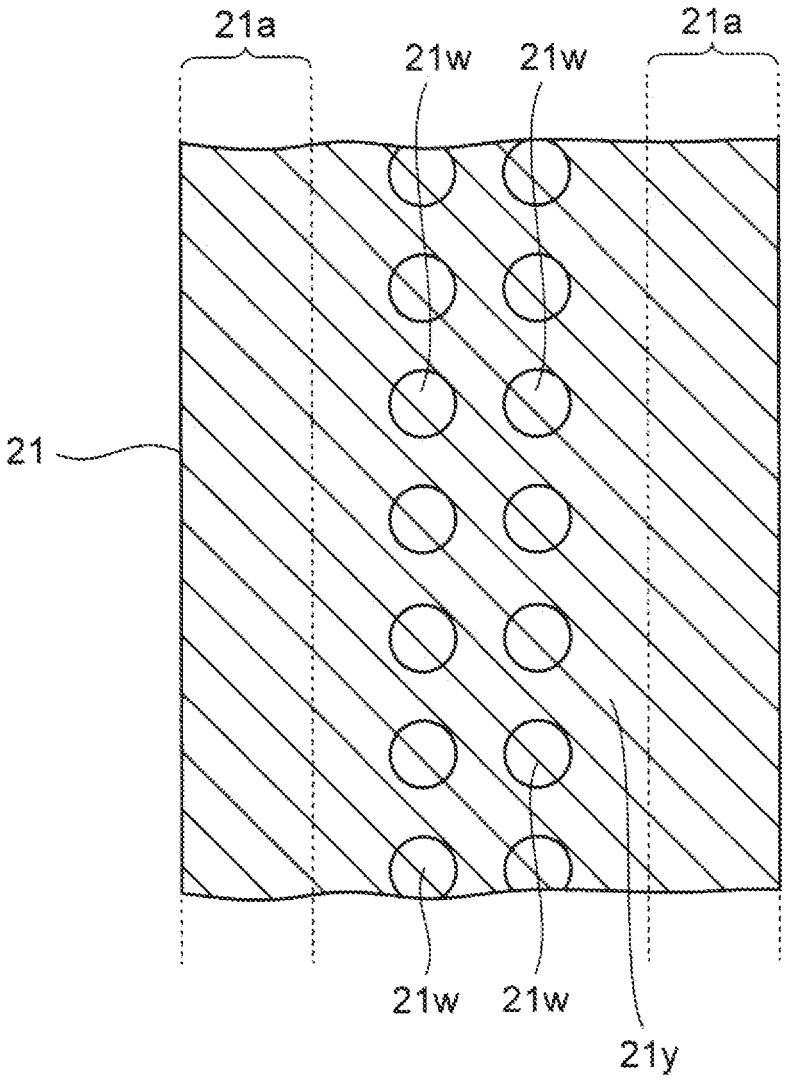
FIG. 30 is an enlarged plan view of a lower-side metal layer according to a third modification of the second embodiment.

FIG. 30 is an enlarged plan view of a lower-side metal layer 21 according to a third modification.

In this example, the planar shape of each of recesses 21$w$ is circular, and the recesses 21$w$ are formed at intervals in an inner-side surface 21$y$. Such recesses 21$w$ are disposed selectively in portions of the lower-side metal layer 21 that are desired to be warped. Thus, only necessary regions in the lower-side metal layer 21 can be warped.

Incidentally, since the planar shape of each of recesses 23$w$ formed in an upper-side metal layer 23 is also the same as the planar shape of each of the recesses 21$w$, the description of the recess 23$w$ will be omitted.

Fourth Modification

Figure 31:
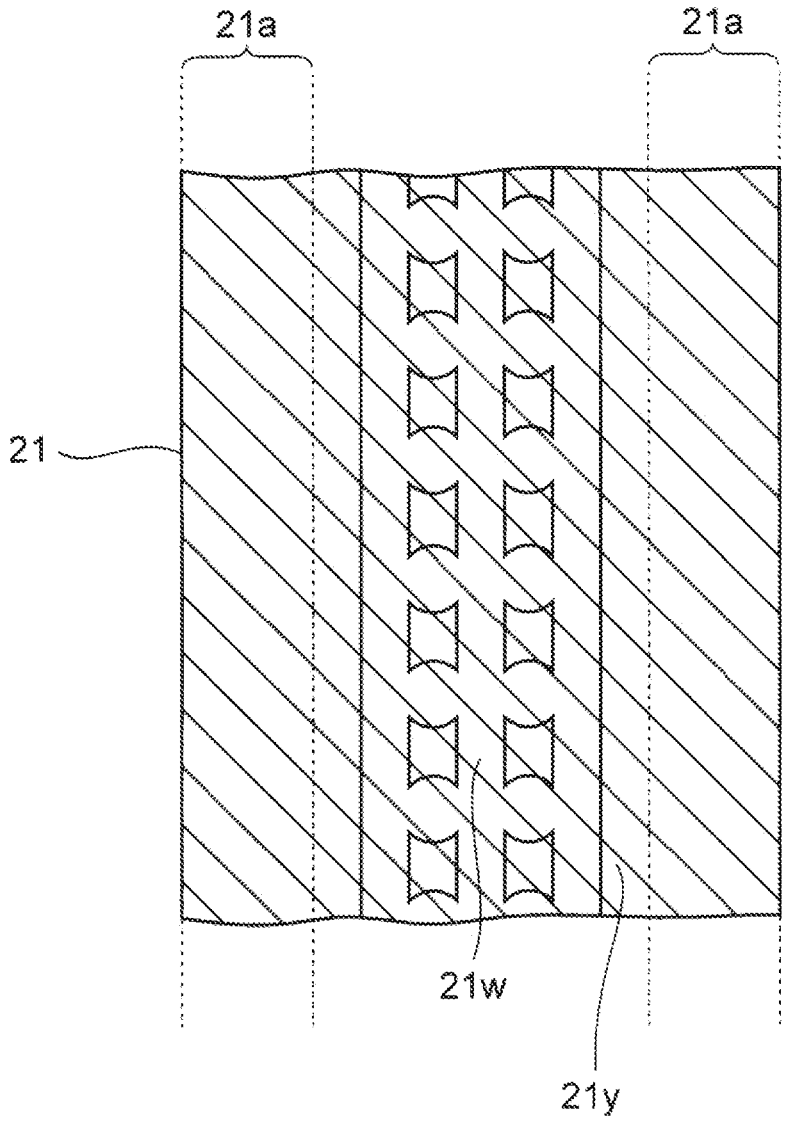
FIG. 31 is an enlarged plan view of a lower-side metal layer according to a fourth modification of the second embodiment.

FIG. 31 is an enlarged plan view of a lower-side metal layer 21 according to a fourth modification.

In this example, a recess 21$w$ includes three grooves extending like stripes in an extending direction of a vapor pipe 15 and bottomed circular holes provided between adjacent ones of the grooves. The recess 21$w$ is formed in an inner-side surface 21$y$.

Since the planar shape of each of recesses 23$w$ formed in an upper-side metal layer 23 is also the same as the planar shape of each of the recesses 21$w$, the description of the recess 23$w$ will be omitted.

As described above, the exemplary embodiment and the modification are described in detail. However, the present invention is not limited to the above-described embodiment and the modification, and various modifications and replacements are applied to the above-described embodiment and the modifications without departing from the scope of claims.

Various aspects of the subject matter described herein are set out non-exhaustively in the following numbered clauses:

(1) A method of manufacturing a loop type heat pipe, wherein the loop type heat pipe comprises:

an evaporator that is configured to vaporize a liquid working fluid;

a condenser that is configured to condense the vaporized working fluid into the liquid working fluid;

a vapor pipe that is provided between the evaporator and the condenser and through which the vaporized working fluid flows; and a liquid pipe that is provided between the evaporator and the condenser and through which the liquid working fluid flows, wherein each of the vapor pipe and the liquid pipe comprises:

a lower-side metal layer;

an intermediate metal layer that is disposed on the lower-side metal layer;

an upper-side metal layer that is disposed on the intermediate metal layer; and a conduit that is formed by the lower-side metal layer, the intermediate metal layer, and the upper-side metal layer, the method comprising:

(a) increasing pressure inside the conduit to thereby warp at least one of the upper-side metal layer and the lower-side metal layer outward in a first portion of the vapor pipe; and (b) enclosing the working fluid into the conduit, (2) The method according to clause (1), wherein the step (a) comprises vaporizing the working fluid by heat to thereby warp the at least one of the upper-side metal layer and the lower-side metal layer by pressure of the vaporized working fluid after the step (b).

(3) The method according to clause (1), wherein the step (a) comprises introducing gas with higher pressure than atmospheric pressure into the conduit to thereby warp the at least one of the upper-side metal layer and the lower-side metal layer by the pressure of the gas before the step (b).

(4) The method according to clause (2), wherein one of the upper-side metal layer and the lower-side metal layer is thicker in thickness than the other of the upper-side metal layer and the lower-side metal layer in the first portion of the vapor pipe.

(5) The method according to clause (1), wherein in a second portion of the vapor pipe, a width of the conduit is decreased from the upper-side metal layer toward the lower-side metal layer, the upper-side metal layer and the lower-side metal layer warp outward, and a warp amount of the lower-side metal layer is smaller than a warp amount of the upper-side metal layer.

(6) The method according to clause (1), further comprising:

forming a recess in the at least one of the upper-side metal layer and the lower-side metal layer in the first portion of the vapor pipe.

What is claimed is:

1. A loop type heat pipe comprising:

an evaporator that is configured to vaporize a liquid working fluid;

a condenser that is configured to condense the vaporized working fluid into the liquid working fluid;

a vapor pipe that is provided between the evaporator and the condenser and through which the vaporized working fluid flows; and a liquid pipe that is provided between the evaporator and the condenser and through which the liquid working fluid flows, wherein each of the vapor pipe and the liquid pipe comprises:

a lower-side metal layer;

an intermediate metal layer that is disposed on the lower-side metal layer;

an upper-side metal layer that is disposed on the intermediate metal layer; and a conduit that is formed by the lower-side metal layer, the intermediate metal layer, and the upper-side metal layer, and the upper-side metal layer and the lower-side metal layer, which are opposed to the conduit, warp outward in a first portion of the vapor pipe to define an outward bulge therein, wherein a height of an approximately widthwise central portion of the conduit is larger than a thickness of the intermediate metal layer in the first portion of the vapor pipe, the thickness of the intermediate metal layer extending an entire distance between opposed interior surfaces of the upper-side metal layer and the lower-side metal layer at a widthwise position at which the intermediate metal layer is provided.

2. The loop type heat pipe according to claim 1, wherein an approximately widthwise central portion of the upper-side metal layer and the lower-side metal layer warps larger in the first portion of the vapor pipe than other widthwise portions thereof.

3. The loop type heat pipe according to claim 1, wherein in a second portion of the vapor pipe, a width of the conduit is decreased from the upper-side metal layer toward the lower-side metal layer, and a warp amount of the lower-side metal layer is smaller than a warp amount of the upper-side metal layer.

4. The loop type heat pipe according to claim 1, wherein each of the upper-side metal layer and the lower-side metal layer has a bonding portion that is bonded to the intermediate metal layer and a pipe wall portion that faces the conduit, and the pipe wall portion of at least one of the upper-side metal layer and the lower-side metal layer is thinner in thickness than the bonding portion of the at least one of the upper-side metal layer and the lower-side metal layer.

5. The loop type heat pipe according to claim 1, wherein the liquid pipe further comprises a porous member that is provided inside the conduit and that is configured to hold the liquid working fluid.

6. The loop type heat pipe according to claim 5, wherein the porous member is provided in a first portion of the liquid pipe, and at least one of the upper-side metal layer and the lower-side metal layer warps outward in a second portion of the liquid pipe.

7. The loop type heat pipe according to claim 1, wherein a recess is formed in the at least one of the upper-side metal layer and the lower-side metal layer in the first portion of the vapor pipe.

8. The loop type heat pipe according to claim 7, wherein the recess is a groove extending along an extension direction of the vapor pipe.

9. The loop type heat pipe according to claim 7, wherein the recess comprises a plurality of recesses, each of the plurality of recesses is shaped like a circle in plan view, and the plurality of recesses are formed in the at least one of the upper-side metal layer and the lower-side metal layer at predetermined intervals.

10. The loop type heat pipe according to claim 7, wherein the recess comprises a plurality of recesses, and the plurality of recesses are arranged in a lattice pattern in plan view.

* * * * *